US010235908B2

(12) United States Patent
Yazdi et al.

(10) Patent No.: US 10,235,908 B2
(45) **Date of Patent: *Mar. 19, 2019**

(54) TAMPER-PROOF ELECTRONIC BOLT-SEAL

(71) Applicant: Evigia Systems, Inc., Ann Arbor, MI (US)

(72) Inventors: Navid Yazdi, Ann Arbor, MI (US); William Kwolek, Manchester, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/125,843

(22) Filed: Sep. 10, 2018

(65) Prior Publication Data

US 2019/0012936 A1 Jan. 10, 2019

Related U.S. Application Data

(63) Continuation of application No. 15/291,029, filed on Oct. 11, 2016, now Pat. No. 10,109,221.

(60) Provisional application No. 62/284,914, filed on Oct. 12, 2015.

(51) Int. Cl.

| | |
|---|---|
| ***G08B 1/08*** | (2006.01) |
| ***G09F 3/03*** | (2006.01) |
| ***G08B 13/06*** | (2006.01) |
| ***E05B 39/00*** | (2006.01) |

(52) U.S. Cl.

CPC ..... *G09F 3/0329* (2013.01); *E05B 39/005* (2013.01); *G08B 13/06* (2013.01); *G09F 3/0317* (2013.01)

(58) Field of Classification Search

USPC ..... 340/571, 572.1, 539.31; 70/91; 292/327

See application file for complete search history.

(56) References Cited

U.S. PATENT DOCUMENTS

| | | | | |
|---|---|---|---|---|
| 7,170,409 | B2 | 1/2007 | Ehrensvard et al. | |
| 7,239,238 | B2 | 7/2007 | Tester et al. | |
| 7,400,247 | B2 | 7/2008 | Hopman et al. | |
| 7,938,459 | B2 | 5/2011 | Terry et al. | |
| 8,279,067 | B2 | 10/2012 | Berger et al. | |
| 8,963,172 | B2 | 2/2015 | Mullis et al. | |
| 10,109,221 | B2 * | 10/2018 | Yazdi | E05B 39/005 |
| 2005/0268000 | A1 | 12/2005 | Carlson | |
| 2006/0202824 | A1 | 9/2006 | Carroll | |

OTHER PUBLICATIONS

International Preliminary Report on Patentability dated Apr. 17, 2018, for counterpart International application PCT/US2016/056553.

* cited by examiner

*Primary Examiner* — Brent Swarthout

(74) *Attorney, Agent, or Firm* — James M. Smedley LLC; James Michael Smedley, Esq.

(57) ABSTRACT

A tamper-proof bolt-seal incorporating a unique identification tamper detection sensor that cannot be restored or duplicated after the bolt. The sensor employs a resistive sensor wire embedded in the bolt. The resistive sensor wire has a randomized length to enable a unique resistive value for that sensor. The resistive value of the sensor is combined with an electronic identification code to create the unique seal identification for the tamper detection sensor, therefore giving the bolt a seal identification that is unique and that cannot be restored or duplicated.

20 Claims, 17 Drawing Sheets

TAMPER-PROOF ELECTRONIC BOLT-SEAL

CROSS-REFERENCE TO RELATED APPLICATIONS

This application claims the benefit of U.S. Nonprovisional patent application Ser. No. 15/291,029 filed on Oct. 11, 2016, now U.S. Pat. No. 10,109,221, and entitled "Tamper-Proof Electronic Bolt-Seal", which claims the benefit of U.S. Provisional Patent Application No. 62/284,914 filed on Oct. 12, 2015, and entitled "Tamper-Proof Electronic Bolt-Seal", which are hereby incorporated by reference in their entirety.

GOVERNMENT SUPPORT

This invention was made with government support under (contract HSHQDC-15-C-00012 awarded by US Department of Homeland Security. The government has certain rights in the invention.

FIELD OF THE INVENTION

The present invention generally relates to a tamper-proof electronic bolt-seal for container tracking. Specifically, embodiments of the present invention employ a combination of electronic identification code and an internal unique resistive sensor value to form a seal unique ID. In some embodiments, the resistive sensors and contacts also serve as breach sensors.

BACKGROUND OF THE INVENTION

In the shipping industry, it is important to ensure the security of the containers and other conveyances to protect against the smuggling and trafficking of contraband, such as weapons, counterfeit goods, and illegal aliens, that occurs when such contraband is inserted into ordinary and common goods containers. As a result, various locks, seals, and other security devices and protocols are available that attempt to thwart the illegal shipment of goods. However, the ever increasing sophistication of illegal smuggling and trafficking operations have rendered currently available security devices inadequate. In particular, currently available are defeated by a wide array of techniques, including by bypassing their security sensors, reassembly of locks and seals, and the mimicking of security identification codes. This is problematic because not only are the containers subject to being breached, but also it can also be difficult to detect whether a breach has occurred.

Therefore, there is a need in the art for tamper-proof bolt-seal that is resistant to being compromised by tampering techniques, but also capable of detecting when tampering has occurred even after the lock, bolt, or seal has been reassembled by the perpetrator. In particular, there is a need in the art for a tamper-proof bolt-seal that detects, records, reports breach attempts and its breach sensor cannot be deactivated, and therefore cannot be disassembled and reassembled without detection or otherwise be duplicated or mimicked. These and other features and advantages of the present invention will be explained and will become obvious to one skilled in the art through the summary of the invention that follows.

SUMMARY OF THE INVENTION

Accordingly, embodiments of the present invention are directed to an electronic tamper-proof bolt-seal that has a low cost and is easy to install. In a preferred embodiment, the tamper-proof bolt-seal is configured to provide electronic recording and reporting of bolt-seal tampering without increasing inspection times at customs and security checkpoints. The tamper-proof bolt-seal is configured to be installed and removed in a way that is identical to existing bolt-seals. In the preferred embodiment, the electronic tamper-proof bolt-seal addresses the protection gap that is the result of the unregistered disassembly and reassembly of currently available bolt-seals, as well as the counterfeiting and duplication of the security identification codes associated therewith.

According to an embodiment of the present invention, an electronic security device, the device comprising a mechanical fastener configured to physically secure a container latch in a closed position, at least one non-zero electrical resistor embedded in the mechanical fastener, wherein the non-zero electrical resistor has a resistance value that changes when the mechanical fastener is tampered with, and electronics, circuitry, and a digital memory that contains a unique electronic identification code for the electronic security device, wherein the electronic identification code is combined with the resistance value of the non-zero electrical resistor to create a unique seal identification code when the electronic security device is fastened to the container latch.

According to an embodiment of the present invention, the resistance value of the non-zero electrical resistor is randomized during manufacturing.

According to an embodiment of the present invention, the non-zero electrical resistor is formed by a wire winding.

According to an embodiment of the present invention, the electronic security device further comprises an armature around which the wire winding is wrapped.

According to an embodiment of the present invention, the wire winding has a randomized length that corresponds to the resistance value.

According to an embodiment of the present invention, the non-zero electrical resistor is formed by a contact disk.

According to an embodiment of the present invention, the non-zero electrical resistor is formed by a miniature discrete resistor.

According to an embodiment of the present invention, the electronics include a battery.

According to an embodiment of the present invention, the electronics include a wireless link.

According to an embodiment of the present invention, the wireless link is a passive radio identification frequency (RFID) protocol and at least of portion of the electronics is powered up when the electronic security device is in proximity to a reader.

According to an embodiment of the present invention, a change in the resistance value of the non-zero electrical resistor is detected as a breach event and recorded in the digital memory.

According to an embodiment of the present invention, the electronics include an electronic timer.

According to an embodiment of the present invention, a time of the breach event is recorded in the digital memory.

According to an embodiment of the present invention, the electronics include a global positioning system (GPS) module.

According to an embodiment of the present invention, a location of the breach event is recorded in the digital memory.

According to an embodiment of the present invention, a plurality of non-zero electrical resistors are employed and the resistance value is a combined resistance value of all of the non-zero electrical resistors.

According to an embodiment of the present invention, tampering with the electronic security device will cause a resistance value change in at least one of the non-zero electrical resistors.

According to an embodiment of the present invention, the electronics encrypt data for storage in the digital memory and wireless transmission.

According to an embodiment of the present invention, the mechanical fastener is a bolt seal comprising a bolt shank comprising a bolt head, a bolt shaft, and a bolt tip, and a bolt lock assembly comprising a bolt lock formed with a bore that is configured to engage with the bolt tip.

According to an embodiment of the present invention, the bolt shank further comprises an alignment key adapted to align the bolt shank with the bolt lock assembly and an alignment key slot adapted to retain the alignment key.

According to an embodiment of the present invention, the electronic security device further comprises an enclosure formed with a collar configured to engage with the bolt head, wherein the enclosure is configured to retain the electronics, the circuitry, and the digital memory.

According to an embodiment of the present invention, the enclosure further comprises a jam nut that is configured to engage with the collar to attach the enclosure to the bolt head to the enclosure.

According to an embodiment of the present invention, the mechanical fastener is a cable seal.

According to an embodiment of the present invention, a method for detecting a breach attempt on an electronic security device, the method comprising the steps of attaching the electronic security device to a container latch to establish a continuity circuit for the electronic security device, wherein the continuity circuit has a baseline resistance value, generating a unique seal identification based in part on the baseline resistance value of the continuity circuit and an electronic identification code associated with the electronic security device, recording the unique seal identification to a data store as an original seal identification, scanning the electronic security device to obtain a current seal identification of the electronic device, comparing the current seal identification to the original seal identification, and issuing an identification mismatch alert for any mismatch between the current seal identification and the original seal identification.

According to an embodiment of the present invention, the method for detecting a breach attempt on an electronic security device further comprising the steps of recording any resistance change in said baseline resistance value that is outside of a tolerance threshold as a breach event, wherein the electronic security device self-monitors for the resistance change, scanning the electronic security device to retrieve any the breach event that has been recorded, and issuing a breach event alert for any the breach event.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
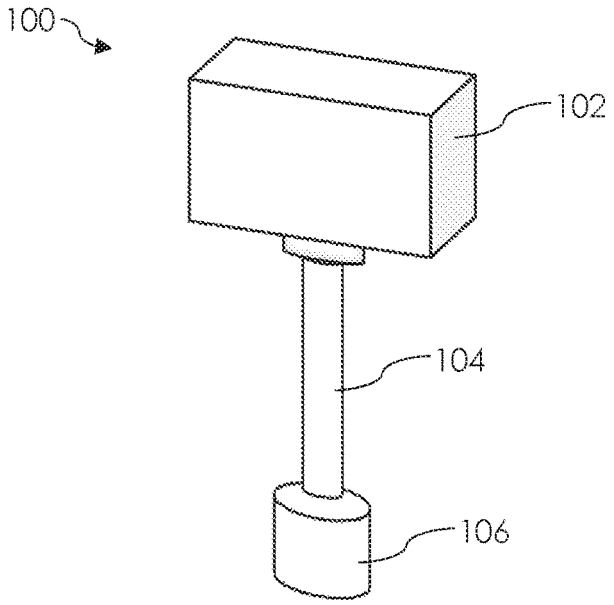
FIG. 1 is an illustration of a tamper-proof electronic bolt-seal in accordance with an embodiment of the present invention.

This invention presents a tamper-proof bolt-seal incorporating a tamper detection sensor that continuously monitors for tampering attempts and generates a unique seal identification that cannot be restored or duplicated in the event of a tampering event, such as after the bolt has been cut. The sensor employs at least a resistive sensor element, wherein the resistive sensor element is preferably a wire embedded in the bolt. In the preferred embodiment, the resistive sensor wire has a randomized length to enable a unique resistive value for that sensor. Alternatively, instead of a resistive wire, other resistive elements such as miniature discrete resistors, molded or 3D printed resistive discs and parts could be employed in the bolt-seal. In the preferred embodiment, the resistive value of the resistive sensor element is combined with an electronic identification code to create the unique seal identification for the tamper detection sensor, therefore giving the bolt-seal a seal identification that is unique. This unique seal identification cannot be restored or duplicated if the bolt-seal is tampered with, since the value of the resistive sensor element will change and become unrecoverable in the event of tampering attempt against the bolt-seal.

According to an embodiment of the present invention, the tamper-proof bolt-seal primarily comprises a bolt component and a bolt lock assembly component. In a preferred embodiment, the bolt component comprises the tamper detection sensor, the bolt shank, and the electronics enclosure. The tamper detection sensor primarily comprises at least one resistive sensor wire coiled on an armature and a circuit board to which the armature and resistive sensor wire are attached. The tamper detection sensor assembly is inserted into a shaft formed in the bolt shank. The enclosure is then attached to the head of the bolt shank, thereby enclosing the tamper detection sensor and bolt shank head. The preferred embodiment of the bolt lock assembly component primarily comprises a bolt over-mold, a bolt lock, contact disc, and a retaining ring. In the preferred embodiment, the contact disc is press-fitted into the bottom of the bore of the bolt lock, while the retaining ring is pressed into position within the ring groove, which is a slot formed near the top of the bolt lock bore that has a large diameter that the rest of the bolt lock bore, as well as a larger diameter than the resting diameter of the retaining ring. The contact disc is configured to make contact with the armature of the tamper detection sensor via two contacts that extend vertically from the contact disc. The retaining ring is a flexible ring that will engage with a notch formed on the tip of the bolt shank when the bolt lock is attached to the bolt shank. The bolt over-mold covers the bolt lock and is configured to resist tampering.

According to an embodiment of the present invention, the tamper-proof bolt-seal employs a multifaceted approach to prevent tampering with the seal. In a preferred embodiment, the tamper-proof bolt-seal incorporates a tamper detection sensor that generates a unique seal identification which cannot be duplicated or mimicked. In a preferred embodiment, the tamper detection sensor is implemented by a winding of resistive sensor wire that has a randomized length and is embedded in the bolt shank. By giving the winding of resistive sensor wire a randomized length, which is done during manufacturing, the resistive sensor wire will inherently have a randomized resistive value that correlates to the length of the wire. The randomized resistance value of the resistive sensor wire can be used when generating the unique seal identification for the tamper detection sensor of the bolt-seal. In some embodiments, depending on the design, the tamper detection sensor may also include a selective set of electrical signal contact resistances. Furthermore, the bolt-seal mechanical and electrical interconnect design prohibit the restoration of the unique seal identification, and the bolt-seal cannot be reassembled or replaced in a way that restores the unique seal identification of the tamper detection sensor.

According to an embodiment of the present invention, the tamper proof-electronic bolt-seal of the present invention is readily installed and removed in a way that is identical to existing bolt-seals. In a preferred embodiment, after the tamper-proof bolt-seal has been physically secured to the latch of a shipping container or similar vessel, the electronics of the tamper-proof bolt-seal are armed using a wireless command applied by a mobile computing device or similar handheld interrogator. In the preferred embodiment, the arming process initiates the self-learning of the randomized resistive sensor wire in the tamper detection sensor, thereby generating the unique seal identification. Once a bolt-seal incorporating the tamper proof sensor has been secured, any removal of the tamper-proof bolt-seal will cause a loss of the unique seal identification in a way that cannot be restored or replicated during any reconstruction of the bolt-seal that might be attempted to mask tampering.

According to an embodiment of the present invention, the tamper-proof bolt-seal incorporates a variety of energy-efficient electronics to implement the (i) sensor interface and tamper detection; (ii) unique seal identification and encryption; (iii) wireless communication via Near Field Communication (NFC), Bluetooth Low-Energy (BLE) or any other wireless protocol that are widely supported; (iv) recording and retaining the time, date and location of security breaches in non-volatile memory. In the preferred embodiment, these leverage from the available commercial mass-volume electronic chips resulting in cost savings.

According to an embodiment of the present invention, tamper-proof bolt-seal electronic bolt seal enables the efficient and secure inspection of shipping containers and similar cargo containers at security and customs checkpoints. In a preferred embodiment, mobile computing devices, including but not limited mobile phones, tablet computers, and similar devices, implement software applications that can be used to provide secure connections to cloud-based servers to enable multi-level security without the need for custom infrastructure or inspection hardware.

According to an embodiment of the present invention, the tamper detection sensor of the tamper-proof bolt-seal initially self-detects the randomized resistance value of the wire winding within the tamper detection sensor when an arming command is issued by a mobile computing device. In some embodiments, the measured resistance also includes the resistance of the electrical contacts in the bolt-seal assembly. In the preferred embodiment, the total resistance of the sensor and contacts are stored internally to the bolt-seal as the detection threshold. Once a baseline resistance is established, the electronics of the electronic bolt-seal periodically (e.g. every ten (10) to sixty (60) seconds) check the resistance. After compensating for temperature variances, if the tamper detection sensor and related electronics detect a difference in the resistance that exceeds a given tolerance, then a breach event is recorded. In the preferred embodiment, the time of the breach event is recorded and retained in non-volatile memory. In some embodiments, the bolt-seal may also record the location of the breach event if the seal is equipped with GPS.

According to an embodiment of the present invention, the unique seal identification is a combination of the tamper detection sensor resistance and the serial identification of the bolt-seal itself. In a preferred embodiment, the unique seal identification is encrypted using an encryption key received by from the interrogator in addition to an internal key, and is transmitted back to the interrogator after seal arming. In the preferred embodiment, the mobile computing device (or interrogator) derives the unique seal identification after decrypting the encrypted unique seal identification that was transmitted over a wireless data link to the seal interrogator and uploads it to a secure cloud-based database where the unique seal identification is associated with a particular shipping container or other cargo vessel. This scheme makes duplicating the unique seal identification nearly impossible since it is tied to randomized and unique internal features of the tamper detection sensor (i.e. the winding of resistive sensor wire), encrypted for over-the-air communications, and decrypted at a checkpoint the where the unique seal identification is verified with the container shipment record previously stored in the secure database. In the preferred embodiment that electronics of the encryption, including inserting long time outs between consecutive attempts to read the unique seal identification.

Figure 2:
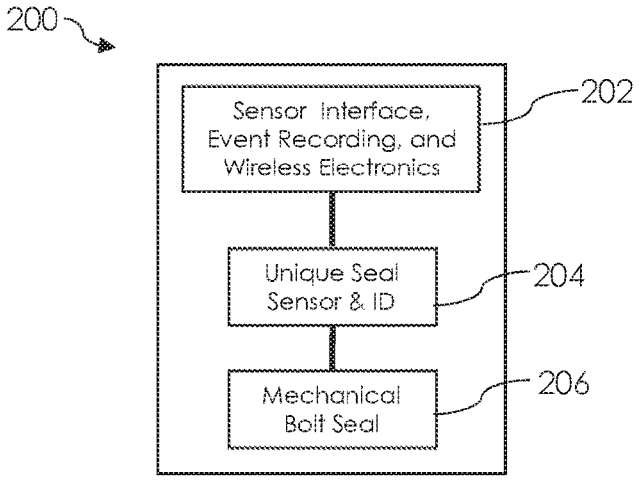
FIG. 2 is block diagram of a tamper-proof electronic bolt-seal in accordance with a preferred embodiment of the present invention.
Figure 3:
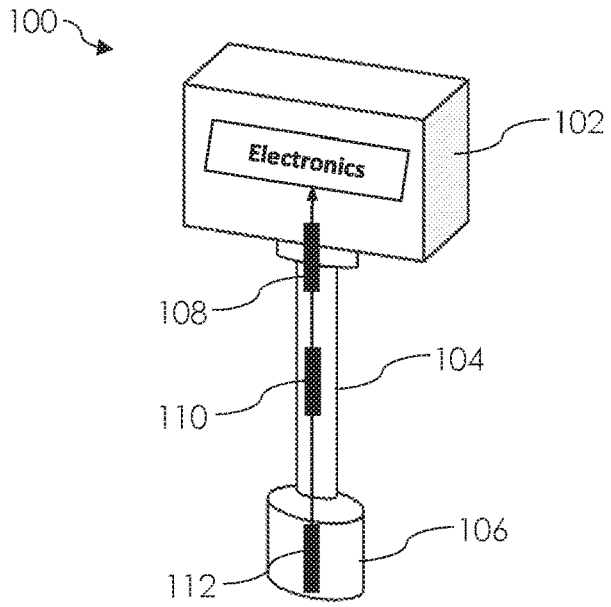
FIG. 3 is a conceptual drawing illustrating the interconnection of the various components of a tamper-proof electronic bolt-seal in accordance with a preferred embodiment of the present invention.
Figure 4:
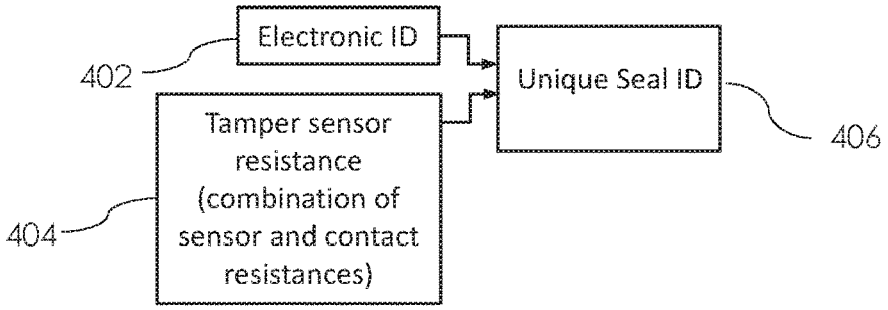
FIG. 4 is a schematic diagram illustrating how a seal unique identification is generated for a tamper-proof electronic bolt-seal in accordance with a preferred embodiment of the present invention.

Turning now to FIGS. 1-4, the overall concept for a tamper-proof bolt-seal and unique seal identification in accordance with an embodiment of the present invention. As shown in FIG. 1, the tamper-proof bolt-seal 100 primarily comprises an enclosure 102 for the various electronic components, a bolt shank or shaft 104, and a bolt lock assembly 106. As shown by FIG. 2, the tamper-proof bolt-seal 200 can be viewed as having three primary elements that contribute to the security of the bolt-seal: the electronics 202 (including the tamper/breach event recording), the unique seal identification 204, and the mechanical portions 206 of the bolt seal. First, there are the mechanical parts of the bolt seal as shown in FIG. 1. In addition, the physical security features, the bolt-seal also relies on the unique seal identification, as well as additional electronic recording components that monitor the status of the unique seal identification. Turning now to FIG. 3, the conceptual diagram shows how the physical and electronic components of the tamper-proof bolt-seal interconnect. The tamper-proof bolt-seal includes at least one resistive element. In the preferred embodiment, the resistive element 108, 110, 112 form a combined electrical path in which a change in its resistance value is detected as a breach. This combined resistance value will also be employed to create an overall unique identification code for the bolt-seal in conjunction with the pre-stored identification code in the electronics module. All or any subset of these resistive elements could be incorporated in the bolt-seal. In the preferred embodiment a winding of resistive sensor wire is used for sensor element 110 passes through the center of the bolt shank shaft 104 of the bolt-seal 100. The sensor element 110 connects between a contact within 108 which has a either zero or non-zero resistance on a circuit board in the enclosure 102 and a contact within element 112 in the bolt lock assembly 106. The contact within element 112 can have a zero or a non-zero resistance value. At least one of the non-zero resistance values in elements 108, 110 and 112 are randomized. The non-zero resistive element can be implemented with different methods including but not limiting to a varying length and diameter of a resistive wire, varying geometries of a resistive disc, and a discrete resistor surface-mount element. Finally, as shown in FIG. 4, the unique seal identification 406 is substantially a combination of the electronic identification 402 of the bolt-seal and the resistance 404 of the tamper detection sensor.

Figure 5A:
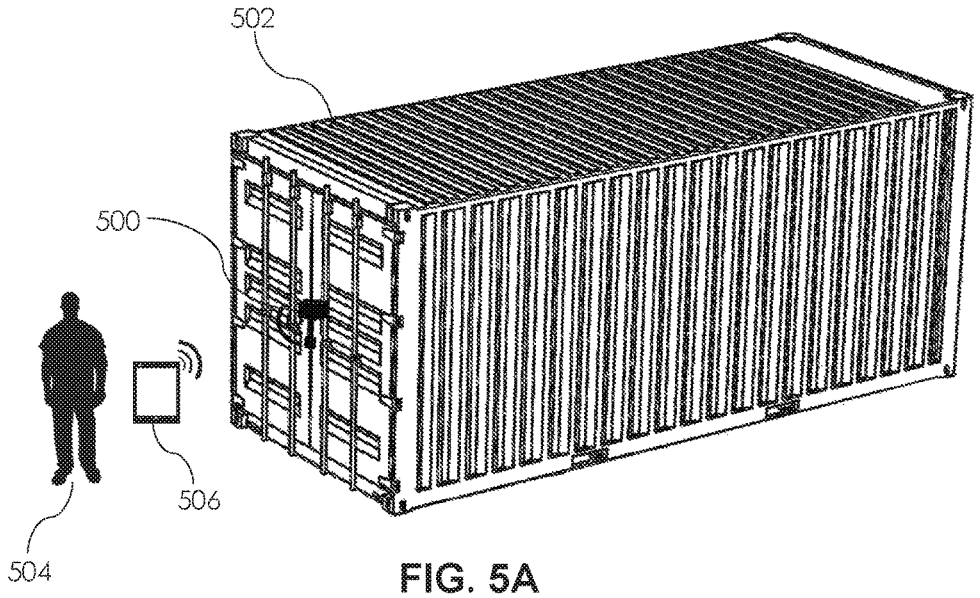
FIG. 5A is an illustration of a tamper-proof electronic bolt-seal in use on a shipping container where a person at an inspection point physically checks the bolt-seal using a mobile computing device in accordance with an embodiment of the present invention.
Figure 5B:
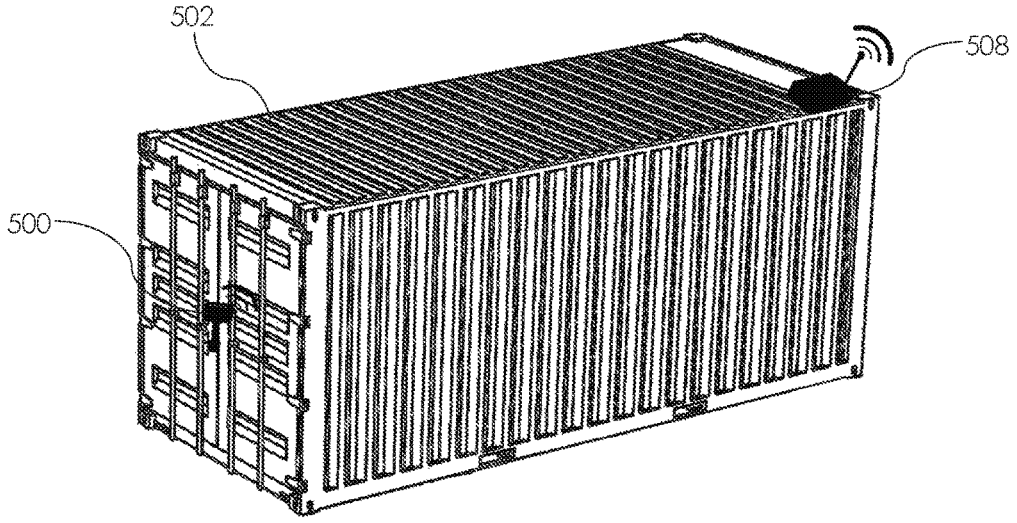
FIG. 5B is an illustration of a tamper-proof electronic bolt-seal in use on a shipping container where automated satellite or cellular container tracking is combined with the tamper-proof electronic bolt-seal in accordance with an embodiment of the present invention.

Turning now to FIGS. 5A and 5B, general use applications for a tamper-proof bolt-seal in accordance with an embodiment of the present invention. As shown in FIG. 5A, a tamper-proof bolt-seal 500 is secured to the latch of a shipping container 502 or similar cargo container, including, but not limited to, ocean containers, intermodal containers, truck trailers, rail cars, and air freight containers. In some embodiments, the bolt-seal 500 is inspected by a person 504 at a checkpoint using a mobile computing device 506, which in a preferred embodiment could be a mobile phone or tablet. As shown by FIG. 5B, a wireless transceiver link 508 (e.g. satellite or cellular transceiver) on the shipping container 502 can support automated real-time (or near real-time) wireless communication and tracking of the tamper-proof bolt-seal 500. In the preferred embodiment, the bolt-seal 500 reports a breach or tampering event through a short range wireless signal to the wireless transceiver link 508, which in turn sends an alert to a server or control center through its network. Alternatively, in another preferred embodiment, the status of the bolt-seal 500 shown in FIG. 5B can be also checked at a checkpoint using a fixed installed interrogator, or a mobile computing device, as shown in FIG. 5A.

According to an embodiment of the present invention, the tamper-proof bolt-seal could be employed in a number of configurations. For example, the tamper-proof bolt-seal could be disposable unit, wherein the bolt-seal is configured for one-time use. Alternatively, the tamper-proof bolt-seal could be a reusable unit, wherein the bolt-seal is configured for multiple uses. In addition to being either disposable or reusable, the tamper-proof bolt-seal may be armed to detect a variety of breaches to the bolt-seal, including, but not limited to, lock pull-offs, breaches of the enclosure, bolt shank cuts, and electronic tampering. Furthermore, the tamper-proof bolt-seal may be equipped with a variety of sensors and modules, including, but not limited to GPS, temperature sensors, wireless communication modules (e.g. Bluetooth®, NFC, etc.), clocks, and power sources (e.g. batteries or wireless power modules). One of ordinary skill in the art would appreciate that the tamper-proof bolt-seal could be adapted in a variety of configurations depending upon a given application and that the bolt-seal is capable of a number of variations without departing from the spirit and scope of the present invention.

According to an embodiment of the present invention, the tamper-proof bolt-seal is configured to detect a variety of techniques that are used to compromise, counterfeit or tamper with bolt-seals. In a preferred embodiment, the breach or tampering event can be sensed and recorded with a time and date stamp. In the preferred embodiment, a variety of tampering or breach events can be detected, including, but not limited to, drilling out the bolt lock, cutting of the bolt shank, detachment of the bolt lock (including replacement by a counterfeit), opening of the electronics enclosure, threading of the bolt lock or bolt shank, renumbering or identification mismatch, and circuit tampering.

Figure 6:
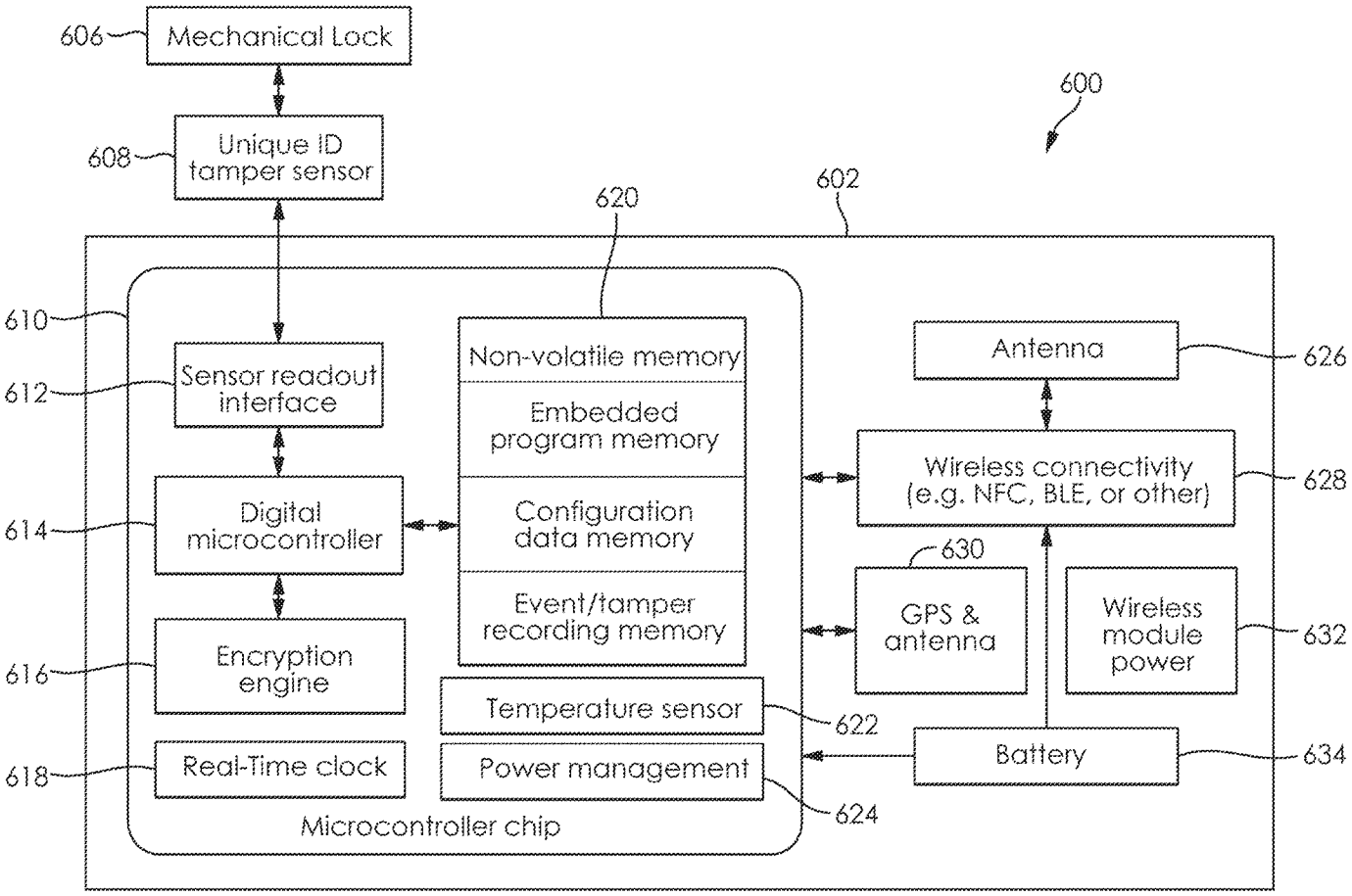
FIG. 6 is block schematic diagram of the components of a tamper-proof electronic bolt-seal with GPS/GNSS in accordance with an embodiment of the present invention.

Turning now to FIG. 6, a block diagram of the electronic components of a tamper-proof electronic bolt-seal with GPS/GNSS in accordance with an embodiment of the present invention. In a preferred embodiment, the tamper detection sensor 608 is a resistive path formed by at least one or a plurality of resistive sensor elements, including but not limiting to, a randomized length of winded resistive sensor wire that extends from a contact on a circuit board in the electronics enclosure through the bolt-seal shank and to a second contact in the bolt-seal lock. In the preferred embodiment, the ohmic resistance of the sensor is periodically checked against the initial self-detected value and if the resistance changes by a set small value, a breach event will be recorded. Preferably, the breach event detection will result in changing the digital seal status data stored on the electronic module, for example by changing the "seal status" digital value. The seal electronics 602 will constantly run a real-time clock ("RTC") 618 and upon the occurrence of a breach event, the event time will be recorded. In the preferred embodiment, the RTC function is supported as part of the microcontroller chip 610 with a low-power draw of resulting in long battery life.

According to an embodiment of the present invention, the sensor readout is performed by applying a voltage pulse across a series combination of the sensor resistor and a known reference resistor, and measuring the current by detecting the voltage drop across the reference resistor. The sensor resistor can be calculated employing the current and applied voltage pulse amplitude. In a preferred embodiment, the key components of the sensor readout electronics are an analog to digital converter (ADC), a series reference resistor, and a digital data processor. In the preferred embodiment, all of the over-the-air data communications are encrypted using a combination of an internal pre-stored key and received key from the mobile interrogator (e.g. mobile computing device). The encryption is preferably performed using an AES-128 hardware engine 616 on the microcontroller chip 610 or its embedded-software implementation, although other encryption methods would be obvious to one of skill in the art. In the preferred embodiment, non-volatile 620 memory is supported by a 16 kB-32 kB flash memory available on the microcontroller chip. The non-volatile memory 620 comprises the embedded program code, configuration data (including self-learning unique identification and internal encryption key), and the tamper/breach event recording data. In the preferred embodiment, the tamper/breach event data includes time of event and may include location data for bolt-seals equipped with a GPS module 630. One of ordinary skill in the art would appreciate that that there are many suitable configurations for the electronics of the tamper-proof bolt-seal, and embodiments of the present invention are contemplated for use with any such configuration.

Embodiments of the present invention may be either disposable or reusable depending upon a variety of factors, including intended use, desired features, and cost considerations. Preferably, reusable embodiments will reuse an assortment of the electronic components of the tamper-proof bolt-seal such as the GPS 630, battery 634, microchip controller 610, wireless communication modules 628, and antennae 626, as well as certain of the mechanical components, such as the enclosure 606. Generally, GPS modules are used only with the reusable bolt-seals due to unit cost considerations and lower cost units that can be considered disposable, depending on the intended use case, typically do not include GPS. However, GPS modules could be used with both reusable and disposable embodiments. In embodiments without a GPS, the location of a breach can be possibly derived or estimated if location versus time information is available from another source such as the container trip plan, as the RTC records the time of a breach or tampering event.

According to an embodiment of the present invention incorporating a GPS unit as shown in FIG. 6, the GPS unit and its antenna are a separate module from the microcontroller chip. The preferred embodiment of the bolt-seal electronics primarily comprises a microcontroller chip 610, battery 634 (and in some embodiments a wireless power sources 632), GPS and antenna 630, and a wireless connectivity module 628 and antenna 626. In the preferred embodiment, the microcontroller chip 610 manages the vast majority of processing and management tasks. Preferably, the microchip controller incorporates number of modules, including, but not limited to, a sensor readout interface 612, a digital microcontroller 614, an encryption engine module 616, a temperature sensor 622, non-volatile memory 618 (which includes embedded software memory, configuration data memory, and event/tamper recording memory), a power management module 624, and a real-time clock 618. One of ordinary skill in the art would appreciate the microcontroller chip could be configured fewer of additional modules depending upon the intended use and desired functions to be performed by the bolt-seal. In the preferred embodiment, power management module will coordinate and control power distribution to the module 600 components, while the temperature sensor will be used to compensate for temperature in the measurement of the resistance of the resistive sensor wire.

Figure 7:
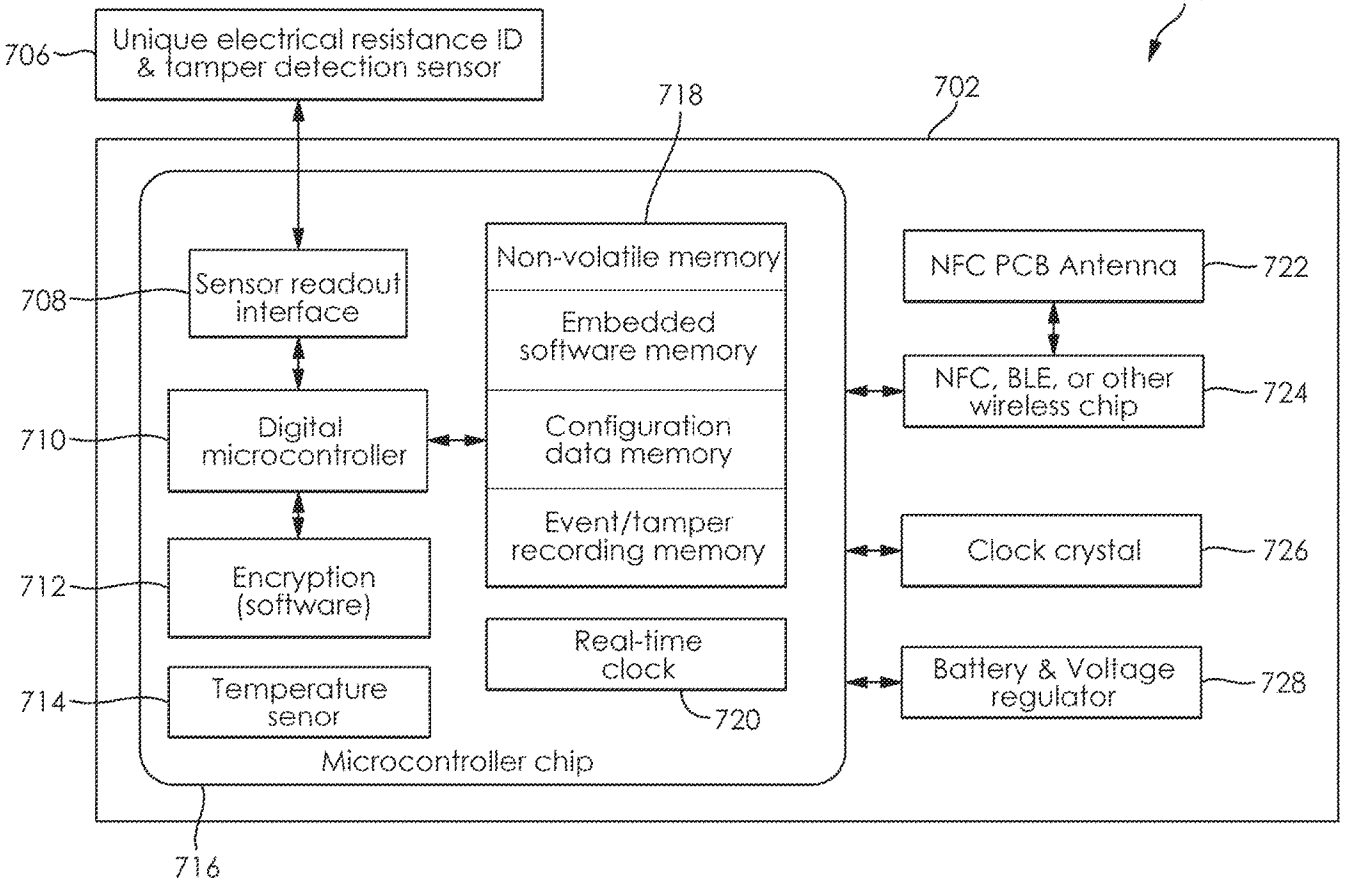
FIG. 7 is block schematic diagram of the electronic components of a tamper-proof electronic bolt-seal without GPS/GNSS in accordance with an embodiment of the present invention.

According to an embodiment of the present invention as shown in FIG. 7, a tamper-proof bolt-seal configured without a GPS module. In a preferred embodiment, the bolt-seal electronics 702 primarily comprise a microcontroller chip 716, battery and voltage regulator 728, clock crystal 726, and a wireless connectivity module 724 and antenna 722. In some embodiments, the wireless connectivity module uses NFC through an antenna on a printed circuit board (PCB). In the preferred embodiment, the microchip controller 716 incorporates number of modules, including, but not limited to, a sensor readout interface 708, a digital microcontroller 710, an encryption engine module 712, a temperature sensor 714, non-volatile memory 718 (including but not limited to embedded software memory, configuration data memory, and event/tamper recording memory), and a real-time clock 720.

According to an embodiment of the present invention, the tamper-proof bolt-seal may be equipped with a GPS module and antenna. In a preferred embodiment, the GPS may draw 20-50 mA for 30-60 seconds when powered up to record the location, depending on its cold-start satellite acquisition time and signal reception strength. In some instances, due to metallic or other obstructions, it is possible that a GPS location fix will not be obtained in this time frame. In the preferred embodiment, the system manages the GPS location retries over a time window after the breach event. Typically, the current draw of GPS will determine the battery requirement. While the total needed capacity is limited, assuming that the breach events are infrequent, the battery should be configured to support the current draw over relatively long time windows in a rugged temperature range of −55 C to 80 C. In the preferred embodiment, lithium-thionyl chloride (Li—SOCl2) or other rugged high-current battery cells are used to meet the demand.

According to an embodiment of the present invention, the tamper-proof bolt-seal may incorporate a wireless communication module. In a preferred embodiment, wireless communication can be performed by near-field communication (NFC), Bluetooth® low-energy (BLE), or any other wireless protocol. Being widely accepted wireless protocols, NFC and BLE have the advantage of higher volume industry chip production and typically lower-cost relative to other protocols. Another advantage of using NFC is that it has a near zero-power draw when not interrogated and can be activated by its reader, accept proprietary secure commands, and receive remote power over its wireless link for powering electronic operations such as encryption and data processing, which enable the module to communicate its status to the interrogator even when the battery is dead or when there is no battery present. The practical communication range of NFC when mobile computing devices are used is a few inches, but the shorter range might be more desired to reduce transmission range in open air, thereby reducing eavesdropping. On the other hand, a BLE link provides longer range communication (up to 100 feet) which, depending on the operation process, may be desired to streamline the inspection of containers. In the preferred embodiment, the BLE link could also integrate need a low-frequency (LF) receiver to initiate the signal transmission when an LF excitor field is detected. In this case, the LF excitor is to be added at the container checkpoints. One of ordinary skill in the art would appreciate that there are many suitable wireless communication protocols, and the bolt-seal could be configured to take advantage of any such wireless communication protocol.

According to an embodiment of the present invention, the electronics of the tamper-proof bolt-seal monitor and record battery voltage levels. In a preferred embodiment, the monitoring of the battery voltage could be useful for detecting breach events, for example when the power is disconnected or drops below a certain threshold (e.g. battery voltage drop below 70% of its capacity is logged along with time of that event). Likewise, the electronics of the tamper-proof bolt-seal can also be configured to record multiple unsuccessful attempts to access the seal information through its secure wireless connection. Multiple unsuccessful could indicate a potential breach or tampering attempt, and in some embodiments will be treated as such based on a predefined rule (e.g. five consecutive incorrect passwords are logged as "password breach" attempt).

According to an embodiment of the present invention, the tamper detection sensor incorporates a winding of resistive sensor wire. In some embodiments, the resistive sensor wire is a single wire, while in other embodiments the resistive sensor wire is two distinct wires. In a preferred embodiment, the resistive sensor wire has a randomized length of 150-300 mm and a 2-4 mil diameter. The wire material is preferably has high-resistance (including, but not limited to Alloy 815, Alloy 875, and Nichrome) with the total sensor resistance of 200-1000 ohms, but the material and design specifics of the sensor could vary depending upon the application or desired characteristics. On the other hand, the reference resistor is in the range of 1000-5000 ohms. In the preferred embodiment, the detection circuitry employs a ratiometric scheme where the applied voltage pulse to the sensor and the ADC reference voltage are proportional in order to cancel out drift and variations of this voltage. Furthermore, the measured resistance is also compensated for temperature. As an illustrative example, with an applied voltage pulse of 3V for 20 milliseconds, reference voltage of 3V, and 12 bits ADC, the minimum detectable (resolution) of the resistance change is ~0.25 ohms, which corresponds to 0.07-0.2 mm effective change in the wire length. The corresponding power draw is 1-3 micro-amperes for a periodic scan every 10-30 seconds, resulting in a battery life of 5-10 years with a 200 mAHr coin cell. As evident, high-resolution, energy-efficient implementation of the tamper detection sensor is achievable. However, in a preferred embodiment, additional battery power may be needed for digital signal processing, as that process effectively reduces the calculated battery life by a factor of 2-4×. This battery life reduction can be compensated by increasing the cell size to 500 mAHr.

Figure 8:
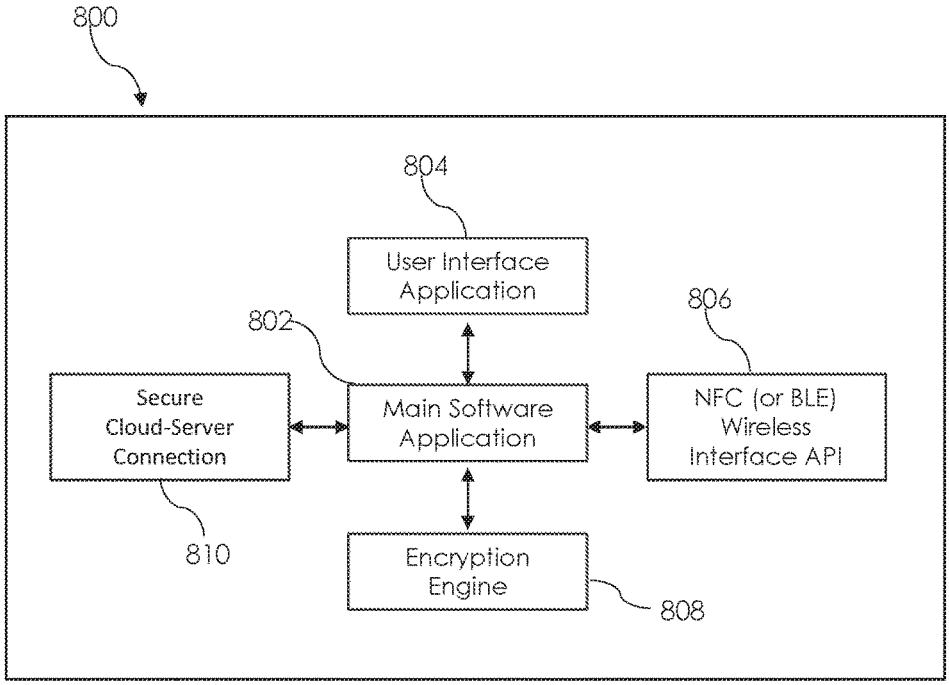
FIG. 8 is block diagram of an application for a mobile computing device to be used with a tamper-proof electronic bolt-seal in accordance with an embodiment of the present invention.

Turning now to FIG. 8, a block diagram of the interrogator (i.e. mobile computing device) software application for a tamper-proof electronic bolt-seal in accordance with an embodiment of the present invention. In a preferred embodiment, the software application 802 provides a user interface 804 through a touch pad, data communication through NFC 806 (or BLE, or other wireless protocol) wireless links via their device software APIs, and implementation of the encryption/decryption functions 808. The software application 800 can also be configured to manage a secure link 810 to a cloud-based database, and associated data transfer.

Figure 9:
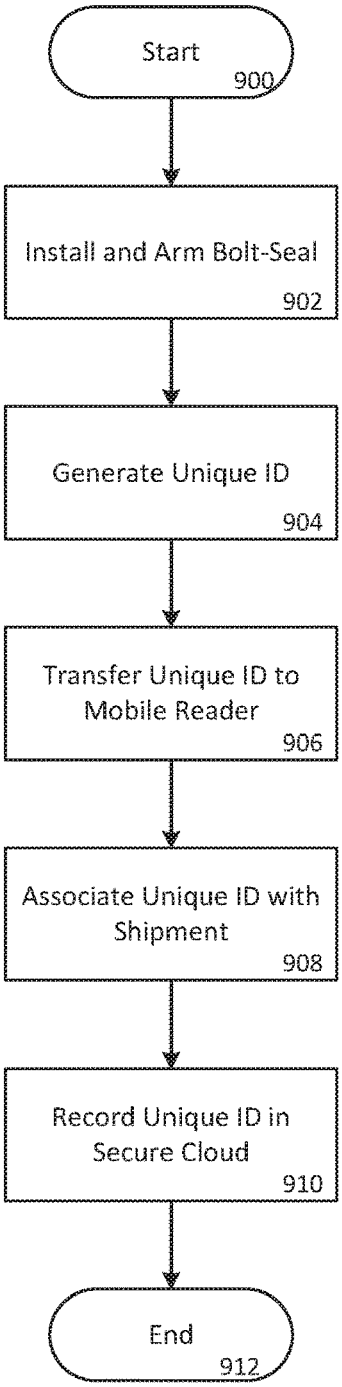
FIG. 9 is a process flow for the installation and activation of a tamper-proof electronic bolt-seal in accordance with an embodiment of the present invention.

According to an embodiment of the present invention, the tamper-proof bolt-seal is installed on a shipping container at the point of origin. In a preferred embodiment, the primary steps for installing and initiating the bolt-seal at the origin are shown by the process flow in FIG. 9. The process starts at step 900, with a user preparing the bolt-seal for installation. Next, at step 902, the bolt-seal is installed on the shipping container and the user employs a mobile computing device to issue an arming command to the bolt-seal, which causes the bolt-seal to self-sense the resistance of the resistive sensor wire in the tamper detection sensor and establish and record a breach threshold. As a result, at step 904, the bolt-seal generates the unique seal identification. Consequently, at step 906, the unique seal identification is encrypted and transferred to the mobile computing device. Next, at step 908, the unique seal identification is associated with a specific shipment via the mobile computing device. Furthermore, at step 910, the unique seal identification and shipment association information are uploaded to a secure cloud based tracking system. Finally, at step 912, the process ends with shipping container being ready for shipment. While this operation sequence is quite efficient with minimal or no additional time burden compared with the current mechanical bolt-seal installations, variations of these processes could be also employed. The objective is to enhance the process to make it more efficient, robust and secure.

Figure 10:
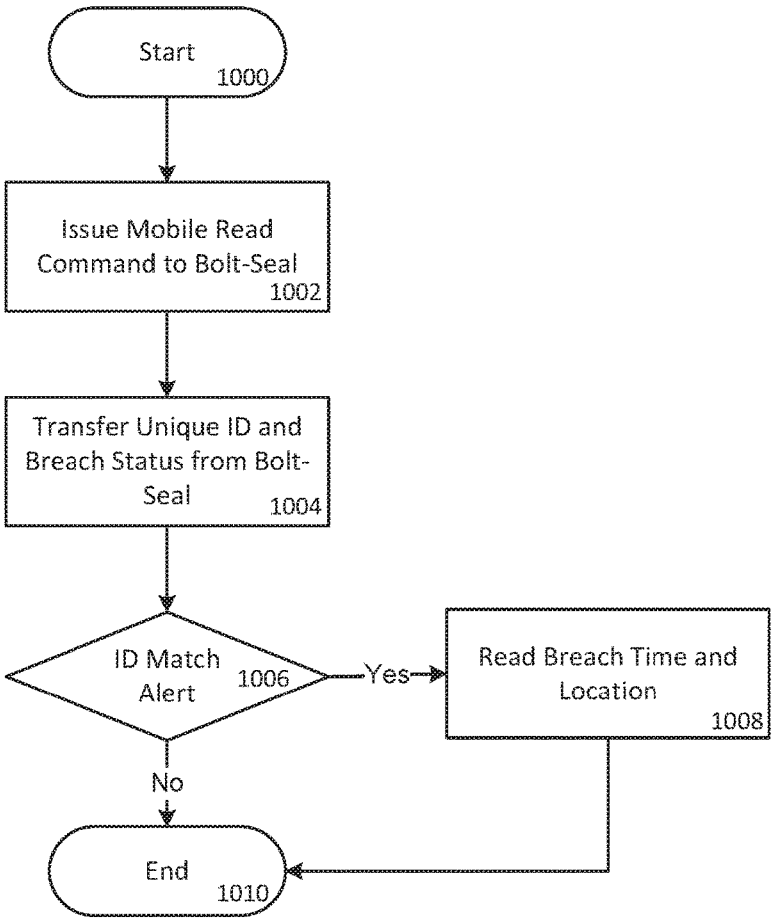
FIG. 10 is a process flow for the inspection sequence of a tamper-proof electronic bolt-seal in accordance with an embodiment of the present invention.

According to an embodiment of the present invention, the tamper-proof bolt-seal is inspected for breach or tampering events at the destination of the shipping container or at any security checkpoint. In a preferred embodiment, the primary steps for inspecting the bolt-seal at a checkpoint are shown by the process flow in FIG. 10. The process starts at step 1000, with the initial inspection of the bolt-seal, which could include an overall physical inspection. Next, at step 1002, a user or inspector uses a mobile computing device to issue a mobile read command to the bolt seal. As a result, at step 1004, the encrypted unique seal identification is transferred to the mobile computing device where it is decrypted to check the breach status by comparing the transferred seal indentation against the one that had been recorded to the server. Next, at step 1006, a warning alert is issued if the identification transferred from the bolt-seal does not match the identification previously recorded to the server. Following the issuance of a warning alert, at step 1008, a user will be able to read the breach time and location. The process will then terminate at step 1010, with the user knowing that the shipment was compromised in some manner. On the other hand, if the identification transferred from the bolt-seal does match the identification previously recorded to the server, then the process will end at step 1010, with the user knowing that the shipment has not been tampered with.

According to an embodiment of the present invention, the tamper-proof bolt-seal is authenticated wirelessly through the use of a wireless interrogator (e.g. mobile computing device, wireless base station, etc.) running the software application as illustrated by FIG. 8. In a preferred embodiment, authentication and transmission via a wireless interrogator running the software application ensures that the unique seal identification (derived from a combination on the bolt-seal electronic serial code and the tamper detection sensor resistance) is protected from transmission to an unauthorized device. In the preferred embodiment, the software application on the wireless interrogator initiates a secure connection with the tamper-proof bolt-seal by sending an authentication key code to the bolt-seal. If the bolt-seal does not receive the proper credentials (i.e. pass keys) it will remain non-responsive. Preferably, multiple unsuccessful attempts of establishing the connection result in the bolt-seal going into a non-responsive mode for hours or even days. Furthermore, such unauthorized access attempts can be recorded, so that they can be reported when the bolt-seal interrogated by an authorized device at an inspection point. In the preferred embodiment, the session authentication key is essentially a password that allows the mobile computing device to access the electronics of the bolt-seal. The system can alternate and manage this password in several ways, including looking up a password from a pre-stored list on both the bolt-seal and the authentic interrogator and that are employed based on the time each session is established.

According to an embodiment of the present invention, the wireless data exchange between the bolt-seal and its wireless interrogator could be encrypted to protect against eavesdropping or unauthorized access attempts. In the latter case, encryption serves as an additional protection layer on top of the communication authentication process described in the previous paragraph. In some embodiments, in may be preferable to use near-field communication (NFC), as the short wireless range minimizes the possibility of eavesdropping, and prevents wireless access to the seal without having physical access to it.

The tamper-proof bolt-seal of the present invention may have a disposable or a reusable design configuration. In a preferred embodiment, both the disposable bolt-seal, as shown by FIGS. 11-19, the reusable bolt-seal, as shown by FIGS. 20-28, function and look much the same as standard metal bolt-seals, with both embodiments having a bolt shank and a bolt lock. The primary difference between the disposable and reusable designs is the enclosure, in particular the manner in which the enclosure attaches to the bolt and sensor assembly, and the various electronics employed by each of the designs. In particular, the enclosure in the reusable design can be detached from the bolt shank. On the other hand, the bolt shank and bolt lock assembly of both versions of the bolt-seal are essentially the same. In either embodiment, the bolt-seal is installed the same was as current bolt-seals, by sliding the shank of the bolt-seal through the lock mechanism of the shipping container (or other cargo vessel) and attaching the bolt lock to the shank. The bolt lock incorporates the "one-way" snap-on feature, which is typical in the industry, and once attached to the bolt shank, it cannot be removed. To remove the bolt-seal from the lock mechanism, the shank of the bolt-seal is cut with bolt cutters or other cutting tool.

According to an embodiment of the present invention, the bolt shank of the bolt-seal extends from the electronics enclosure. In a preferred embodiment, the bolt shank is formed with a shaft passing through the central axis of the bolt shank that accommodates the resistive sensor wire of the tamper detection sensor. In some embodiments, the armature of the tamper detection sensor may be thin and flat enough so that it is not necessary to line of the bolt shank with a plastic or other insulating tube. In the preferred embodiment, the bolt shank is also formed with a notch in the tip of the bolt shank that is configured to engage with the retaining ring in the bolt lock.

According to an embodiment of the present invention, the bolt lock attaches to the end of the bolt shank that is opposite from the enclosure. In some embodiments, the bolt lock is a standard metal bolt lock that directly contacts the resistive sensor wire to complete the circuit of the tamper resistance sensor. However, in a preferred embodiment, the bolt lock includes an electrical contact, such as a contact disc assembly, to complete the circuit of the tamper detection sensor (i.e. the combination of the circuit board in the enclosure and the resistive sensor wire wrapped around the armature). One of ordinary skill in the art would appreciate that there are many electrical resistive elements that could be used in place of the contact disk.

According to an alternate embodiment of the present invention, the electrical contact may be a carbon slug which functions as an in-series electrical contact for the resistive sensor. The carbon slug is pressed into a blind hole in the bolt lock during manufacture. It is not evident to personnel who install the bolt-seal. The resistive sensor wire is also connected to the circuit board in the enclosure at the top of the bolt-seal. When the bolt lock snaps into place, the wire makes contact with the carbon slug, allowing the carbon slug to serve the purposes of continuity and ohmic resistance. Furthermore, because the carbon slug is in intimate contact with the bolt lock and the bolt lock is in intimate contact with the bolt shank, a closed circuit is established from the circuit board, down through the insulated hole in the bolt shank to the carbon slug wire contact, through the bolt lock, into the bolt shank, and back to the circuit board. Therefore, when the bolt shank is cut or the bolt lock is forced off, this closed circuit is opened and triggers the electronics to recognize a breach event. In embodiments incorporating the reusable design, where the electronic enclosure can be unscrewed from the bolt head, there will be an additional wire (or bolt head wire) leading from the circuit board, through the threaded boss of plastic enclosure, and through a molded-in contact intended to touch the head of the bolt shank. Preferably, the bolt head wire will be in-series with the resistive sensor wire. When the bolt-seal installation is completed, there is no visible evidence of wires. Furthermore, even before the bolt shank and bold lock are mated, only the contact between the wire and carbon slug is visible According to an embodiment of the present invention, the two halves of the disposable design enclosure will be ultrasonically welded to the bolt head. In the preferred embodiment, the bolt head will have an interlocking feature to ensure a secure, permanent and robust fastening. In the preferred embodiment, a single fastening will help reduce the manufacturing cost.

According to an embodiment of the present invention, the reusable embodiment has GPS capability, therefore a larger battery is needed to acquire satellite signals. Additionally, the circuit board in the reusable embodiment will be populated with GPS electronics and antenna. For those reasons, the enclosure will be larger in reusable embodiments. In the preferred embodiment, positioning of the GPS antenna should be optimized to improve signal reception. Except for the removable features in the reusable design, the enclosure of the reusable embodiment will be molded in halves which are ultrasonically welded together in substantially the same manner as the disposable embodiment.

According to an embodiment of the present invention, the reusable design allows the installer to unscrew the electronics enclosure from the bolt head. To reuse the tamper-proof bolt-seal, personnel will cut the bolt shank, thereby allowing the bolt-seal to be removed from the container door lock. The personnel will then unscrew the enclosure from the upper half of the cut bolt. A new bolt can then be screwed into the threaded boss of the old enclosure. The unit will now be ready to receive a new unique identification when a new resistive sensor wire and armature are inserted through the bolt.

According to an embodiment of the present invention, the bolt lock employs a one-way connection to the bolt shank through the use of a retaining ring or split ring. In a preferred embodiment, the retaining ring contracts from its resting or formed diameter to a smaller diameter when pressed into the bolt lock bore but then expands back to its resting diameter when the retaining ring reaches the ring grove formed in the bolt lock. As the bolt shank is pushed onto the bolt lock, the tip of the bolt shank causes the retaining ring to expand from its resting diameter. Eventually, when the retaining ring notch of the bolt shank passes the ring grove of the bolt lock, the retaining ring contracts back to its resting diameter and engages with the notch in the bolt shank. This arrangement firmly secures the bolt shank within the bolt lock and completes the physical installation of the bolt lock on the bolt shank. The retaining ring firmly secures the bolt lock to the bolt shank because when in the resting diameter, the retaining spring is small enough in diameter to prevent the bolt shank from being pulled back through the retaining ring and large enough in diameter to prevent the retaining ring from being pulled out of the bolt lock bore. In particular, the bolt shank cannot be pulled bank past the retaining ring because of the notch in the tip of the bolt shank and the retaining ring cannot be pulled out of the bolt lock bore because of the retaining ring grove in the bolt lock.

According to an embodiment of the present invention, the tamper-proof bolt-seal may employ a modular design to provide for a lower manufacturing costs. Furthermore, modular design and the use of various subassemblies are important for automated assembly, which is important for low manufacturing costs. In a preferred embodiment, the tamper detection sensor has two primary subassemblies, the resistive wire sub-assembly (which includes the armature) and the circuit board sub-assembly. Preferably, the resistive sensor wire is securely coiled around the armature and terminated in a way that does not require soldering, thereby making the resistive wire sub-assembly more amenable to automated assembly.

According to an embodiment of the present invention, the resistive wire sub-assembly primarily comprises the resistive sensor wire and the armature. In a preferred embodiment, the armature is a plastic part, onto which the resistive sensor wire is wound. In some embodiments, the armature may be a 3D printed part, while in other embodiments it is injection molded. In the preferred embodiment, the resistive sensor wire is two separate wires, each of which has a serpentine arrangement where it curls around a series of off-set knobs formed down each side of the armature. Specifically, the resistive sensor wire begins at the top of the armature with a length of wire (e.g. a contact lead) that is configured for contact with the circuit board. Specifically, the head portion of the armature features one or more attachment points that permit the armature to be joined to the circuit board in a manner that establishes an electrical connection between the contact lead and the circuit board. The resistive sensor wire then proceeds in a in a double-helix down the armature. Finally, the resistive sensor wire terminates at the tip of the armature in a pair of conductive contact pads or contact leads that are formed from the resistive sensor wire and configured to make contact with the contact disc. In the double-helix arrangement, two resistive sensor wires are wrapped around the armature and retain the contact and attachment points at the top of the armature for the circuit board and the contact at the bottom of the armature for the contact disc. In an alternate embodiment, the resistive wire is a single wire that wraps around the length of the armature. Specifically, the resistive sensor wire is attached to one terminal clip at the top of the armature and wound around the armature where it is repeatedly spot welded to the armature tube, thus securing the wire onto the armature. At the bottom of the armature, the wire is fed back through a tube formed in the center of the armature and back to the top of the armature where it is secure to a second terminal clip. The wire is secured to the bottom of the armature by a rivet. The rivet serves to contact the wire inside the armature tube to a spring in the bolt lock. The bolt lock contacts the bolt shank and the bolt shank head contacts the pigtail from the circuit board. The terminal clips each include a screw for attaching the resistive sensor wire sub-assembly to the circuit board, thereby completing the circuit between the resistive sensor wire sub-assembly and the circuit board sub-assembly.

According to an embodiment of the present invention, there will be multiple circuit continuities, some of which may be in parallel. Preferably, the first circuit will be the resistive sensor wire coiled or wrapped along the armature and intended to sense a cut bolt. The second will be a pigtail wire soldered to the circuit board at one end and in intimate contact with the bolt head at the other end. In the preferred embodiment, the pigtail is intended to sense the bolt lock being removed, including, for example, the bolt shank being separated from the enclosure. If circuit continuity is broken in either wire, the circuitry will indicate a bolt-seal breach attempt. In some embodiments, rather than a separate pigtail wire, a bolt head contact is incorporated into resistive sensor wire near the top of the armature where the armature connects to the circuit board.

According to an embodiment of the present invention, the resistive sensor wire sub-assembly allows various lengths and diameters of the resistive sensor wire to be installed. In a preferred embodiment, the armature serves as a harness jig or forming board, onto which the resistive sensor wire is wound in a serpentine or helix manner. At the head of the armature, the wires are routed through holes or slots that enable it to lie flat against the surface of the armature. When the screws or other fasters are used to attach the resistive sensor wire sub-assembly to the circuit board, the wires form a line of contact that is squeezed against the circuit board. At the tail of the armature shaft are similar holes and slots that position the resistive sensor wire to be in contact with contact disc in the bolt lock. In a preferred embodiment the resistive sensor wire continuity starts at the circuit board, continues down through one side of the serpentine path on the armature, through the bolt lock, and back up the opposite serpentine path on the opposite side of the armature to the circuit board, thereby completing the circuit. This arrangement allows the resistive sensor wire sub-assembly to sense both a cut bolt shank and a pulled-off bolt lock.

According to an embodiment of the present invention, the bolt lock is a distinct sub-assembly that has an electrical contact integrated into the bolt lock. In a preferred embodiment, the contact is a 3D printed contact disc or similar contact disc assembly. In the preferred embodiment, the contact disc assembly primarily comprises two armature contact members that are connected by a bridge wire, a resistor bridge or a miniature discrete resistor. The bridge wire is embedded in the contact disc in a manner which allows the contact members to extend vertically above the surface of the contact disc. In some embodiments, the contact disc itself is a conductive plastic, thereby eliminating the need for a bridge wire. The armature contact members are configured to make electrical contact with the resistive sensor wire on the armature when the bolt lock is attached to the bolt shank. In the preferred embodiment, the contact disc is press-fit into the bore of the bolt lock. This design effectively allows the bolt-seal to incorporate a second component that has a variable resistance that can be integrated into the unique seal identification. In particular, the bridge wire of the contact disc has a randomized resistance. When two ohmic values are used together in the tamper detection sensor circuit, the number of unique ohmic values increases by statistical combination rather than sequential linearity. Similar to the bolt shank, if the bolt lock is cut or pulled off of the bolt shank, a breach event is detected.

According to an embodiment of the present invention, the bolt shank and bolt lock of the bolt-seal incorporate a keyed assembly technique. In a preferred embodiment, a key slot is formed in both the side of the bottom tip of the bolt shank and in the top of the bolt lock over-mold and an alignment key is fitted to the key slot on the bolt shank. The alignment key is configured to align the bolt shank to the bolt lock over-mold when the bolt lock is being attached to the bolt shank. In the preferred embodiment, the proper alignment of the bolt shank with the bolt lock ensures both mechanical alignment of those components, as well as electrical continuity between the armature of the tamper detection sensor in the bolt shank and the bolt lock contact disc assembly.

According to an embodiment of the present invention, the resistive sensor wire and armature is fastened to the circuit board with self-threading screws. In a preferred embodiment, Plastite® screws are used to fasten the armature to the circuit board. In the preferred embodiment, the combined armature and circuit board assembly are placed into the housing armature first so that the armature passes through a pass-through hole that is formed in the bottom of the enclosure and continues through the armature hole formed in the bolt shank. In particular, the collar on the bottom of the enclosure engages with the head of the bolt shank such that the pass-through hole of the enclosure aligns with the armature hole on the bolt shank cylinder thereby enabling the armature to pass continuously through the bottom of the enclosure and the bolt shank. Once the armature is fully inserted, the circuit board will be aligned in the cavity of the enclosure where it is secured the enclosure by a screw.

According to an embodiment of the present invention, the resistive wire sub-assembly is manufactured using 3D printing techniques. In a preferred embodiment, the armature core is printed from ABS plastic and the conductive features will printed from a PLA and graphene blend. In the preferred embodiment, various conductive materials can be blended to specific ohmic values and are commercially available in a variety of conductive and filament materials. As a result, this allows for numerous combinations of contact disc and armature conductor resistances that both increase the bandwidth of unique ohmic values and simultaneously make programming a shape change for the armature and contact disc conductors unnecessary. The combinational statistics for twenty different conductive materials provides ample bandwidth for unique ohmic values.

According to an embodiment of the present invention, the enclosure is injection molded plastic. In a preferred embodiment, the halves of the enclosure are ultrasonically welded together to form a hermetic seal. However, for testing purposes, the enclosure may be designed with snap-off cover to facilitate access during system tests. Other enclosure attachment and sealing methods, such as chemical bonding, would be obvious to one of skill in the art.

According to an embodiment of the present invention, the reusable bolt-seal has no visible means of disassembly. This anti-tampering design criteria is achieved through two primary features. First, the removable enclosure cover is fastened with a completely concealed machine screw. In particular, a jam nut and the bolt shank must be removed before the enclosure cover screw can be accessed. In the preferred embodiment, the jam nut simultaneously secures the head of the bolt shank to the enclosure and ensures that if the bolt shank is removed, it can be sensed. The jam nut itself is visible from only under the bolt head and appears to be part of the enclosure. It is removed with a simple spanner. In a preferred embodiment, the enclosure also includes an environmental seal for the enclosure body and cover that protects the electronics from outside environment exposure.

According to an embodiment of the present invention, the removal or loosening of the jam nut will trigger a breach alert. In particular, the jam nut is first slipped over the tip of the bolt shank and moved to a position below the head of the bolt shank. Then, the bolt shank head is inserted into the collar at the bottom of the enclosure. Once the bolt shank head is positioned in the collar, the jam nut can be tightened into the collar from beneath the bolt shank head, thereby securing the bolt shank to the enclosure. Moreover, the tightening of the jam nut causes the bolt shank head to press against two bolt head contact wires that are located on the bottom of the head of the armature. With the bolt head contact wires in contact with the bolt shank head at the bolt head contact points, a resistance sensing circuit is closed across the bolt shank head. In the event the jam nut is unscrewed, the circuit continuity will be opened and a breach will be sensed.

According to an embodiment of the present invention, the electronics and mechanical components of the bolt-seal may employ commercially available versions of the components such as the bolt shank, GPS, and wireless transmitter modules. On the other hand, the resistive sensor wire, which is primarily responsible for the randomized nature of the unique seal identification, and armature of the tamper detection sensor is distinct to the present invention. In a preferred embodiment, the length of the resistive sensor wire is randomized during the manufacturing process. In particular, by randomizing the number of turns the resistive sensor wire makes around the armature down to a fraction of a turn, the resistance of the wire is also randomized. In a manufacturing process, this can be controlled and randomized a by microcontroller programming during the manufacturing process. Importantly, there is no need for measuring or determining the resistance of the resistive sensor wire during manufacturing because its unique resistance will be detected by the bolt-seal during activation.

EXEMPLARY EMBODIMENTS

Figure 11:
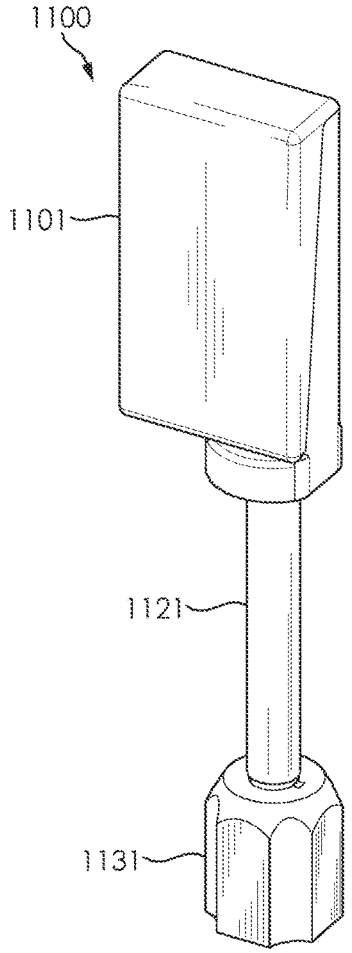
FIG. 11 is a perspective view of a disposable version of a tamper-proof electronic bolt-seal in accordance with an embodiment of the present invention.
Figure 12:
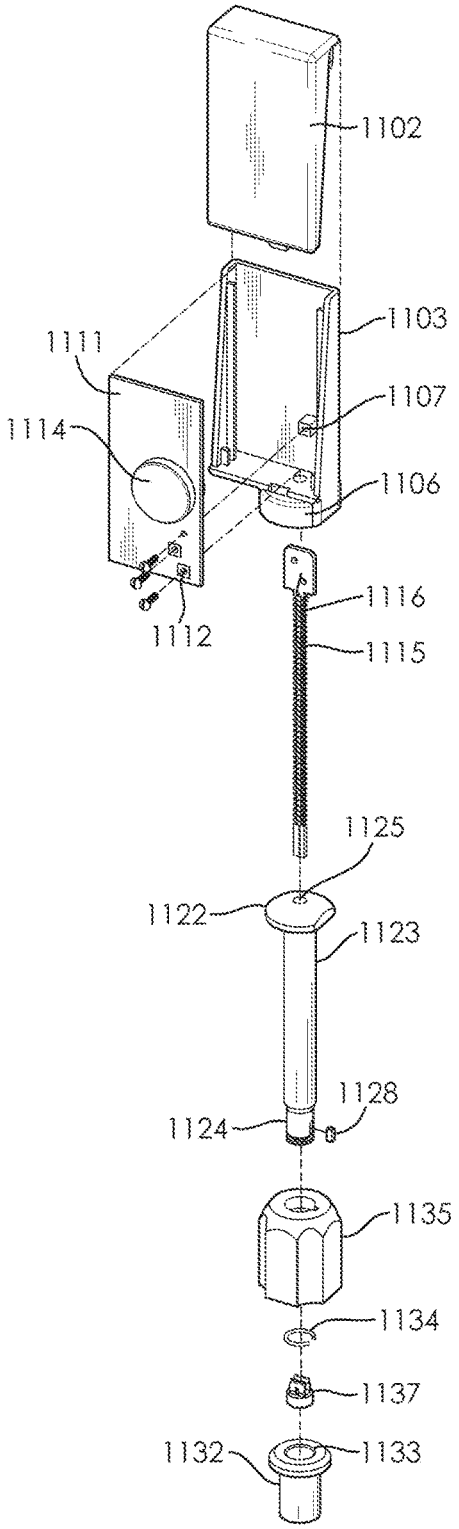
FIG. 12 is an exploded view of a disposable version of a tamper-proof electronic bolt-seal in accordance with an embodiment of the present invention.
Figure 13:
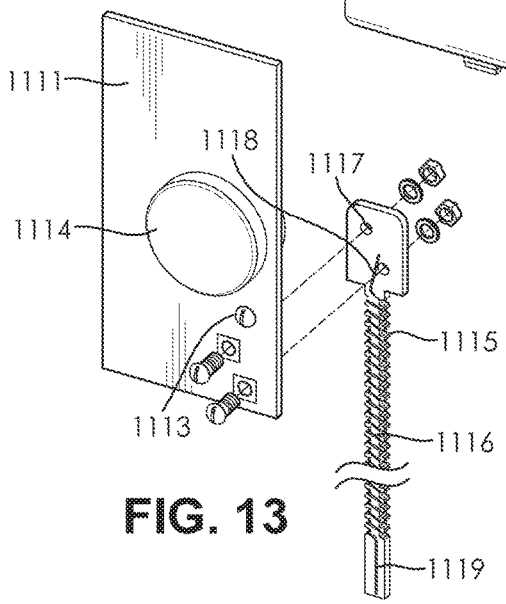
FIG. 13 is an exploded view of the enclosure of a disposable version of a tamper-proof electronic bolt-seal in accordance with an embodiment of the present invention.
Figure 14:
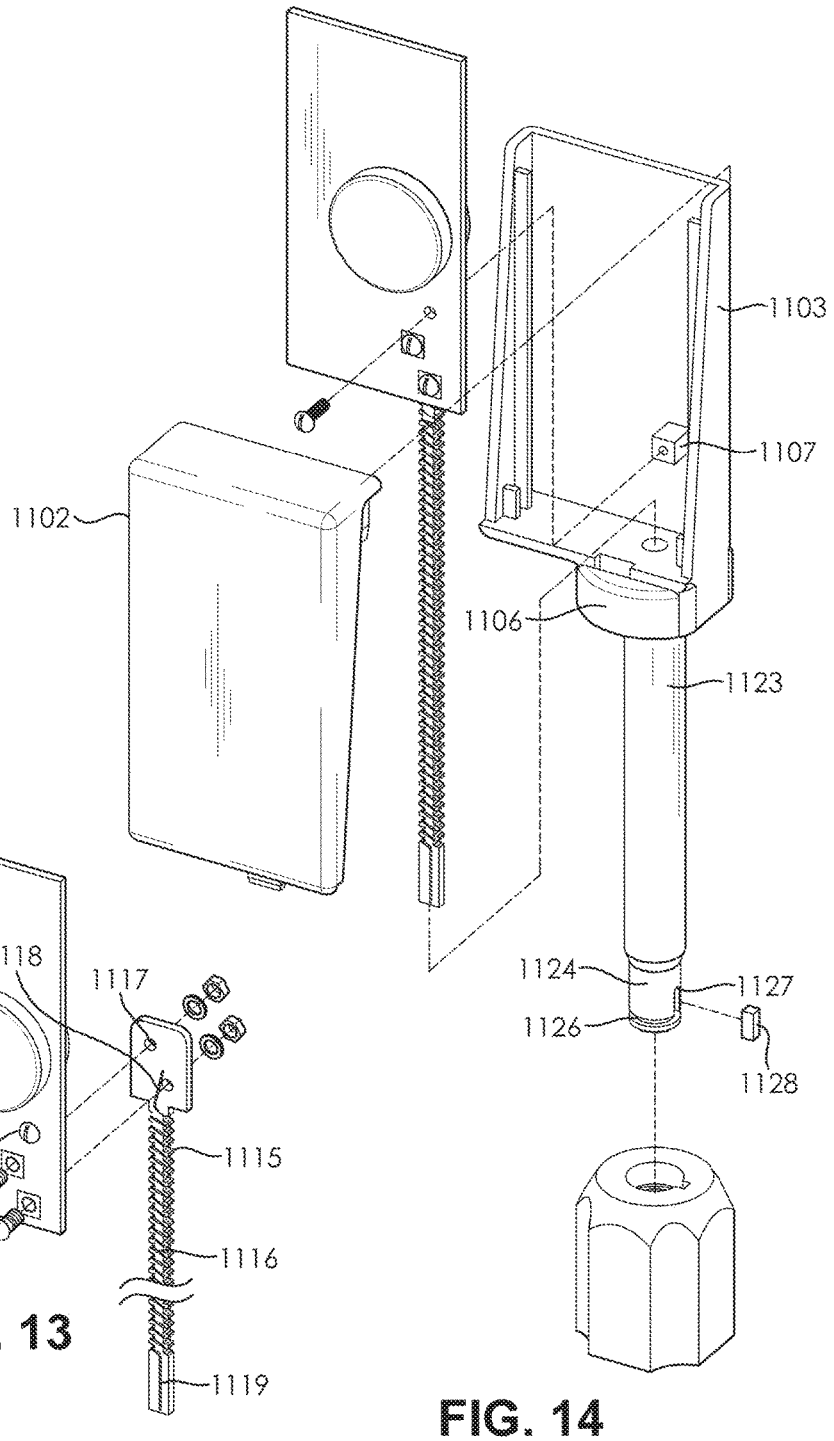
FIG. 14 is an exploded view of the bolt shank of a disposable version of a tamper-proof electronic bolt-seal in accordance with an embodiment of the present invention.
Figure 15:
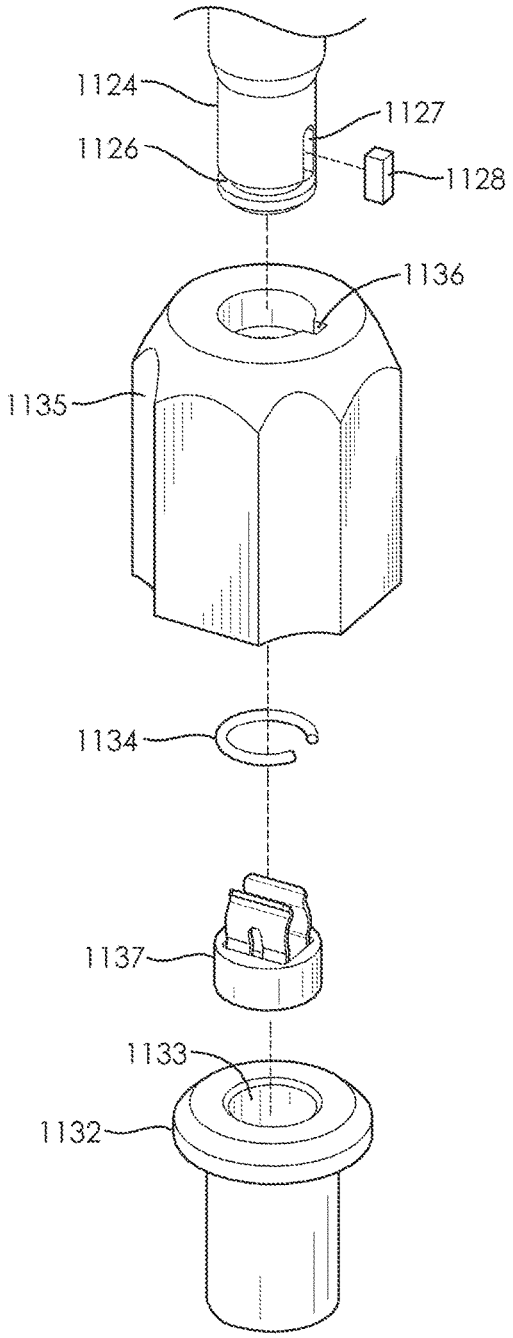
FIG. 15 is an exploded view of the bolt lock assembly a disposable version of a tamper-proof electronic bolt-seal in accordance with an embodiment of the present invention.
Figure 16:
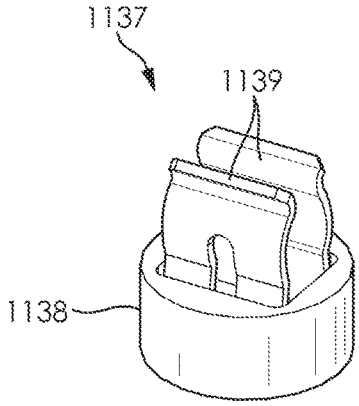
FIG. 16 is a contact disc assembly of a disposable version of a tamper-proof electronic bolt-seal in accordance with an embodiment of the present invention.

Turning now to FIGS. 11-19, a disposable configuration for a tamper-proof electronic bolt-seal in accordance with an embodiment of the present invention. As shown in FIG. 11, the disposable version of the tamper-proof electronic bolt-seal 1100 primarily comprises the electronics enclosure 1101, the bolt shank 1121, and the bolt lock assembly 1131. FIG. 12 shows an exploded view of the various components of the disposable version of the tamper-proof electronic bolt-seal, which are shown in greater detail in FIGS. 13-16. As shown by FIG. 13, the enclosure primarily comprises an enclosure cover 1102 and an enclosure back 1103. The circuit board 1111 of the tamper detection sensor, which includes a battery 1114, attaches to the circuit board attachment point 1107 formed on the enclosure back 1103 using one of the screws 1113 that pass through the circuit board 1111. The enclosure is also formed with a collar 1106 that engages with the bolt shank head 1122 (as shown in FIGS. 12 and 14). As shown in FIG. 14, tamper detection sensor also includes a resistive sensor wire 1115 that is coiled on the armature 1116. The armature 1116 attaches to an attachment point 1112 on the circuit board 1111 using two screws 1113 (as shown in FIGS. 12 and 13) and the holes 1117 formed in the head of the armature 1116. A portion of the resistive sensor wire 1115 is used to form both a circuit board contact 1118 and a bolt lock contact 1119. The resistive sensor wire 1115 and armature 1116 pass through a hole 1125 in the bolt shank shaft 1123 to emerge at the bolt shank tip 1124. As shown in FIG. 15, the tamper-proof electronic bolt-seal also includes a bolt lock assembly that engages with the bolt shank tip 1124. The bolt shank tip 1124 aligns with the bolt lock assembly using an alignment key 1128 pressed into the alignment key slot 1127 on the bolt shank tip 1124. Specifically, the alignment key 1128 aligns the bolt shank tip 1124 with the alignment key notch 1136 in the bolt lock over-mold 1135. When the bolt shank tip 1124 is pressed into the bolt lock assembly, it passes through the bolt lock over-mold 1135 and into bore 1133 of the bolt lock 1132 where the retaining ring notch 1126 engages with the retaining ring 1134. A contact disc assembly 1137 is also press fit into the bolt lock 1132. As shown in FIG. 16, the contact disc assembly primarily comprises two vertical contact members 1139 extending from the contact disc 1138 that are configured to electrically couple with the bolt lock contact 1119 of the armature 1116 (as shown in FIG. 14).

Figure 17:
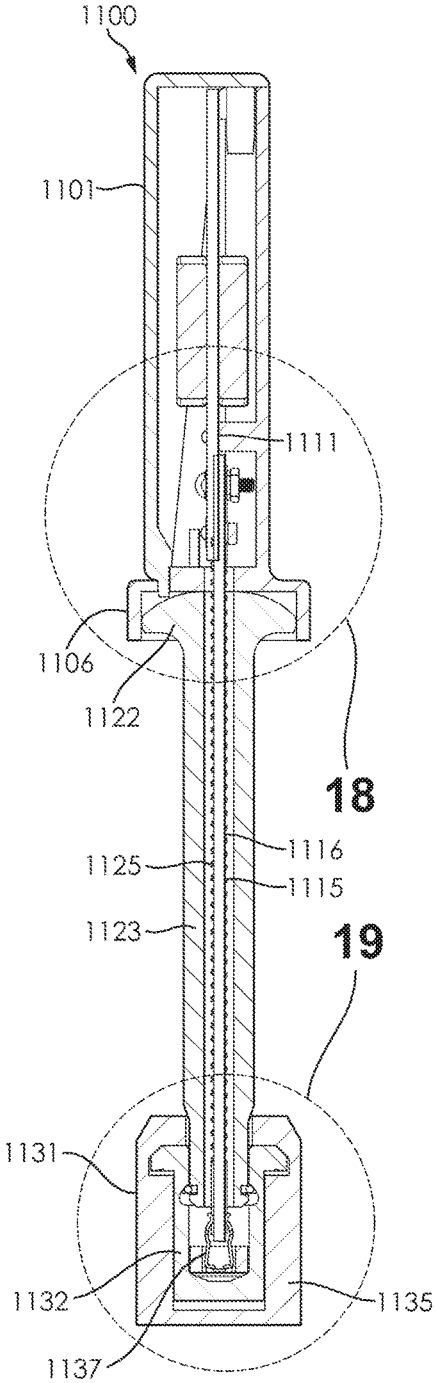
FIG. 17 is cross-section of a disposable version of a tamper-proof electronic bolt-seal in accordance with an embodiment of the present invention.
Figure 18:
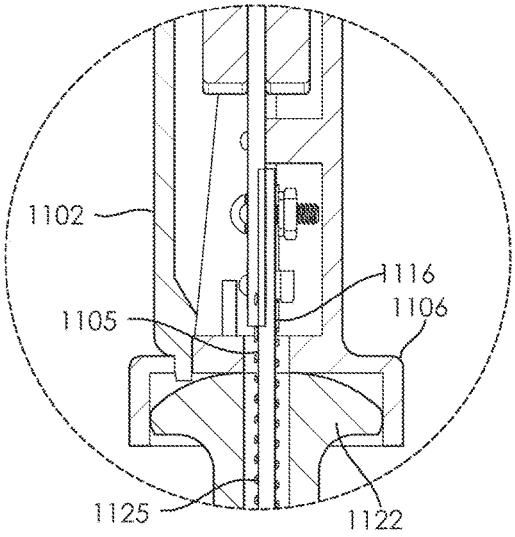
FIG. 18 is a detailed cross-section of the connection between the bolt shank and enclosure of a disposable version of a tamper-proof electronic bolt-seal in accordance with an embodiment of the present invention.
Figure 19:
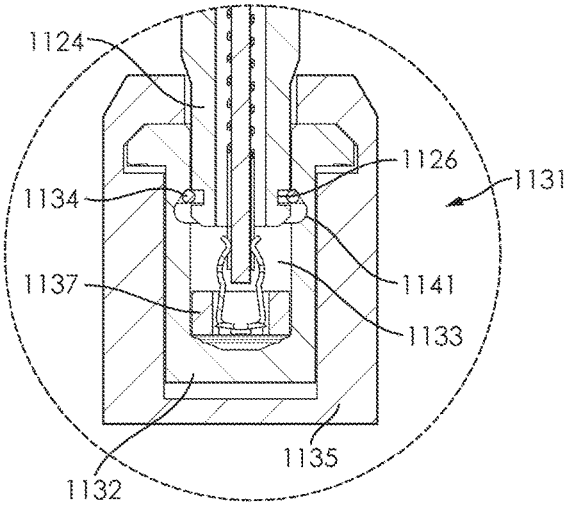
FIG. 19 is a detailed cross-section of the connection between the bolt shank and bolt lock assembly of a disposable version of a tamper-proof electronic bolt-seal in accordance with an embodiment of the present invention.

Turning now to FIG. 17, a cross-section of the disposable version of the tamper-proof electronic bolt-seal, which is shown in greater detail in FIGS. 18 and 19. As shown by FIG. 17, the circuit board 1111 of the tamper detection sensor is housed in the enclosure 1101 and the resistive wire 1115 and armature 1116 of the tamper detection sensor are primarily retained in the hole 1125 formed though the center of the bolt shank shaft 1123. As shown by FIG. 18, a collar 1106 at the bottom of the enclosure 1101 engages with the bolt shank head 1122, while a flange on the bottom of the enclosure cover 1102 engages with a slot formed in the top of the collar 1106. FIG. 18 also shows how the armature 1116 passes through the bottom of the enclosure 1101 via the armature pass-through 1105. As shown by FIG. 19, the bolt lock assembly 1131, attaches to the bolt shank tip 1124. Specifically, as the bolt shank tip 1124 passes through the bolt lock over-mold 1135 and into the bore 1133 of the bolt lock 1132, the retaining ring notch 1126 on the bolt shank tip 1124 passes the retaining ring groove 1141 where the retaining ring 1134 engages with the retaining ring notch 1126. The contact disc assembly 1137 at the bottom of the bolt lock bore 1133 electrically couples with the bolt lock contact on the armature.

Figure 20:
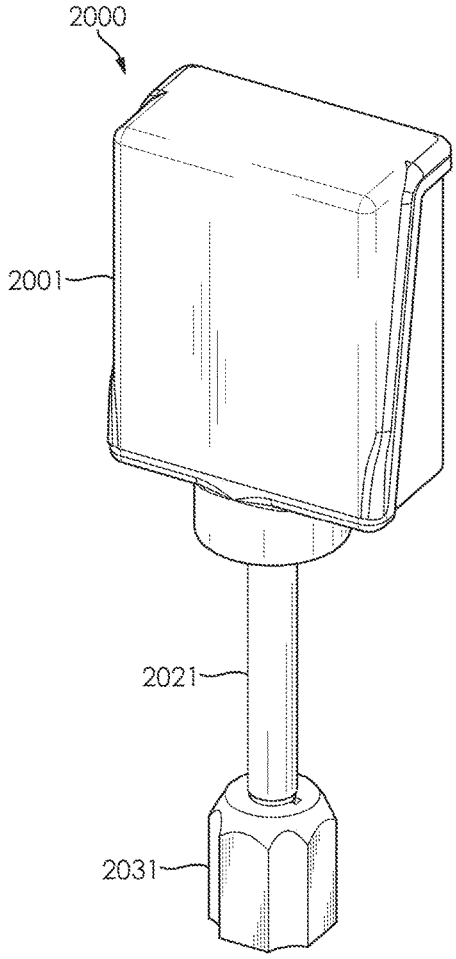
FIG. 20 is a perspective view of a reusable version of a tamper-proof electronic bolt-seal in accordance with an embodiment of the present invention.
Figure 21:
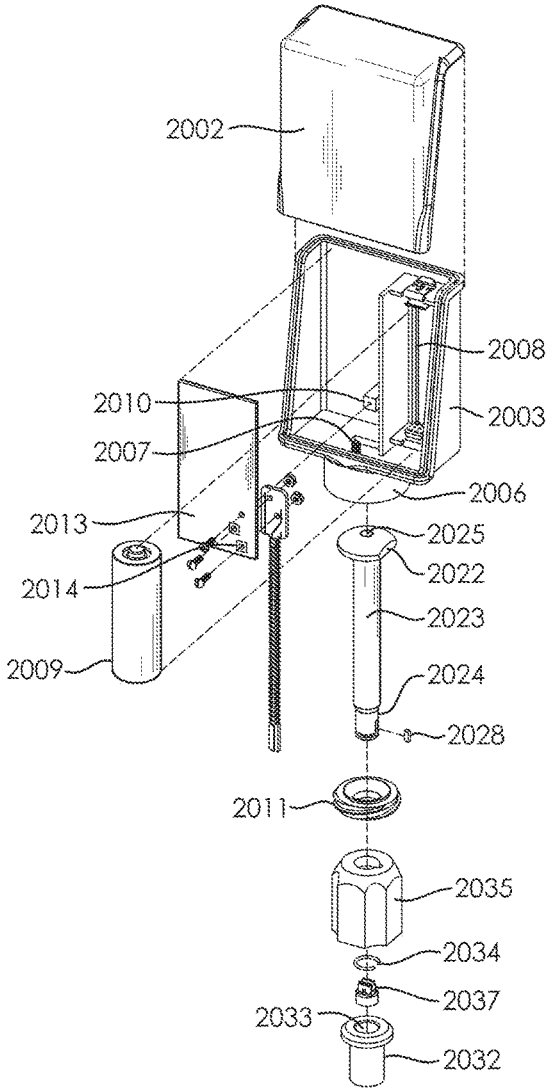
FIG. 21 is an exploded view of a reusable version of a tamper-proof electronic bolt-seal in accordance with an embodiment of the present invention.
Figure 22A:
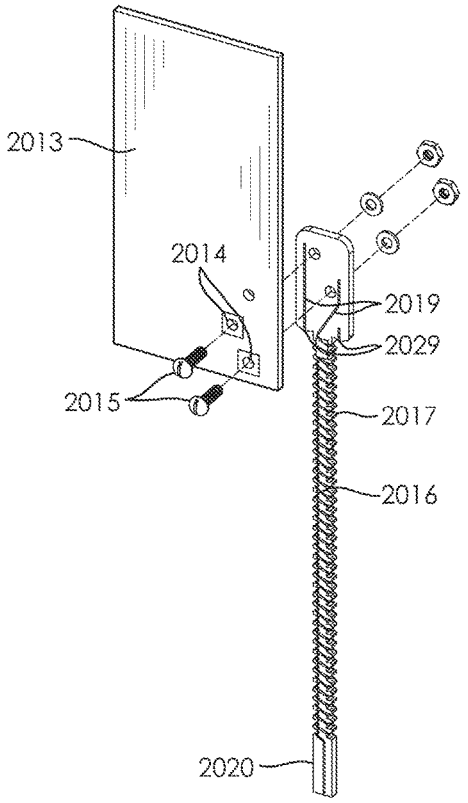
FIG. 22A is an exploded view of the circuitry of a reusable version of a tamper-proof electronic bolt-seal in accordance with an embodiment of the present invention.
Figure 22B:
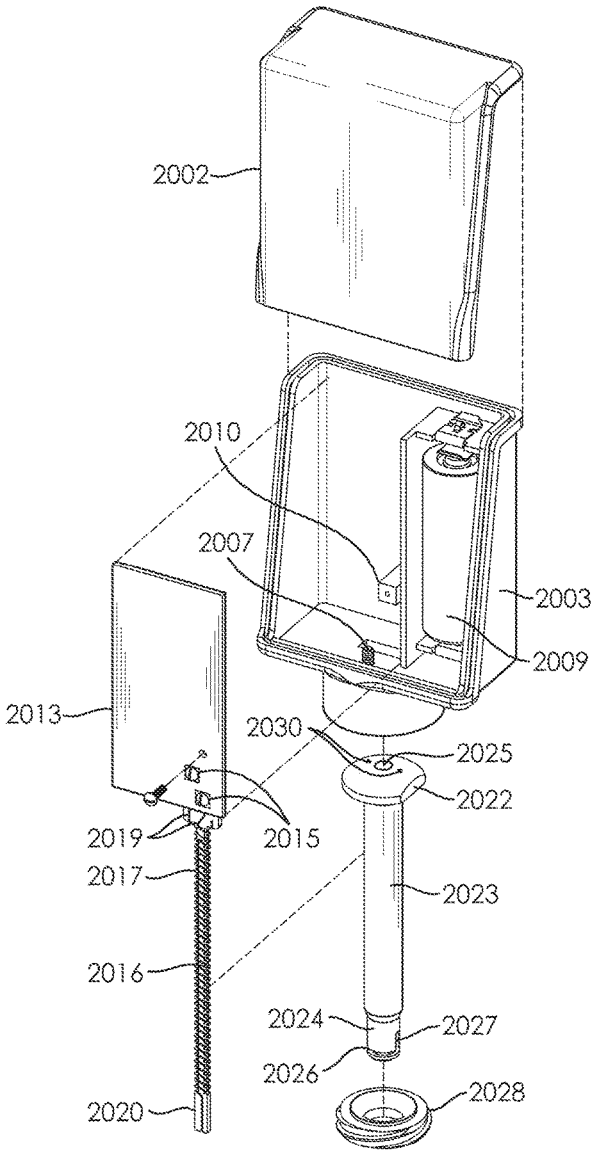
FIG. 22B is an exploded view a reusable version of a tamper-proof electronic bolt-seal in accordance with an embodiment of the present invention.
Figure 23:
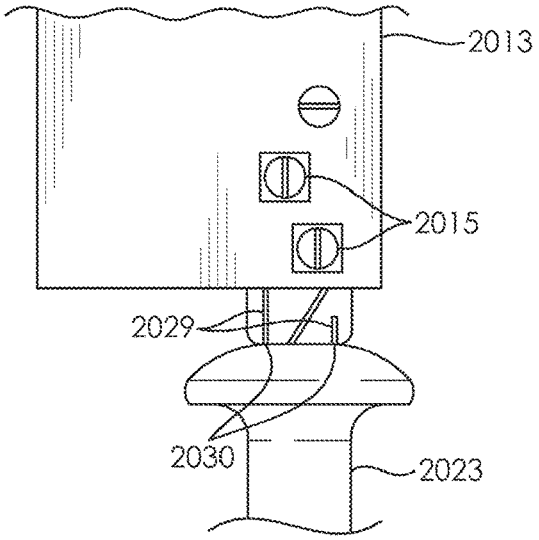
FIG. 23 is a detailed view of the bolt head contact of a reusable version of a tamper-proof electronic bolt-seal in accordance with an embodiment of the present invention.

Turning now to FIGS. 20-29, a reusable configuration for a tamper-proof electronic bolt-seal in accordance with an embodiment of the present invention. As shown in FIG. 20, the reusable version of the tamper-proof electronic bolt-seal 2000 primarily comprises the electronics enclosure 2001, the bolt shank 2021, and the bolt lock assembly 2031. FIG. 21 shows an exploded view of the various components of the reusable version of the tamper-proof electronic bolt-seal, which are shown in greater detail in FIGS. 22-25. As shown by FIG. 22, the enclosure primarily comprises an enclosure back 2003 and an enclosure cover 2002 that is secured to the enclosure back 2003 by an enclosure cover screw 2010. The circuit board 2013 of the tamper detection sensor, attaches to the circuit board attachment point 2010 formed on the enclosure back 2003 using one of the screws 2015 that pass through the circuit board 2013. The enclosure is also formed with a collar 2006 that engages with the bolt shank head 2022 (as shown in FIGS. 21 and 23) using a jam nut 2011. The jam nut 2011 presses the bolt shank head 2022 into contact with two bolt head contact wires 2029 specifically located on the bottom of the head of the armature 2017. When the bolt head contact wires 2029 make contact with the bolt shank head 2022 at the bolt head contact points 2030, the resistance sensing circuit is closed across the bolt shank head 2022. If the jam nut 2011 is unscrewed, the circuit continuity will be opened and a breach will be sensed. Furthermore, the enclosure back 2003 is formed with a battery compartment 2008 configured to retain a battery 2009. As shown in FIG. 23, tamper detection sensor also includes a resistive sensor wire 2016 that is coiled on the armature 2017. The armature 2017 attaches to an attachment point 2014 on the circuit board 2013 using two screws 2015 (as shown in FIGS. 21 and 22) and the holes 2018 formed in the head of the armature 2017. A portion of the resistive sensor wire 2016 is used to form each of a circuit board contact 2019, a bolt head contact 2029, and a bolt lock contact 2020. The resistive sensor wire 2016 and armature

Figure 24:
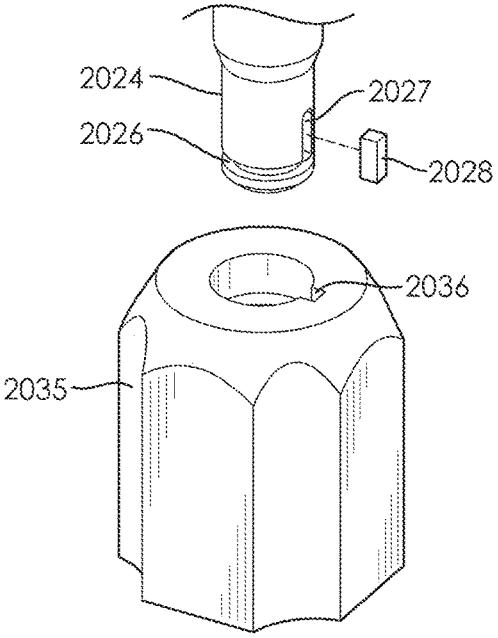
FIG. 24 is an exploded view of a bolt lock over-mold of a reusable version of a tamper-proof electronic bolt-seal in accordance with an embodiment of the present invention.
Figure 25:
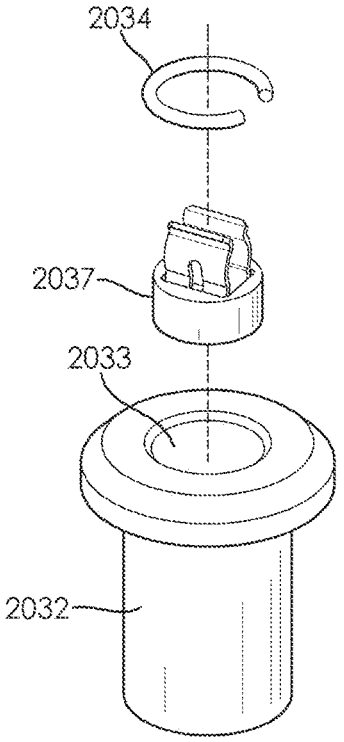
FIG. 25 is an exploded view of a certain components of a bolt lock assembly of a reusable version of a tamper-proof electronic bolt-seal in accordance with an embodiment of the present invention.

2017 pass through a hole 2025 in the bolt shank shaft 2023 to emerge at the bolt shank tip 2024. As shown in FIGS. 24 and 25, the tamper-proof electronic bolt-seal also includes a bolt lock assembly that engages with the bolt shank tip 2024. The bolt shank tip 2024 aligns with the bolt lock assembly using an alignment key 2028 pressed into the alignment key slot 2027 on the bolt shank tip 2024. Specifically, the alignment key 2028 aligns the bolt shank tip 2024 with the alignment key notch 2036 in the bolt lock over-mold 2035. When the bolt shank tip 2024 is pressed into the bolt lock assembly, it passes through the bolt lock over-mold 2035 and into bore 2033 of the bolt lock 2032 where the retaining ring notch 2026 engages with the retaining ring 2034. A contact disc assembly 2037 is also press fit into the bolt lock 2032.

Figure 26:
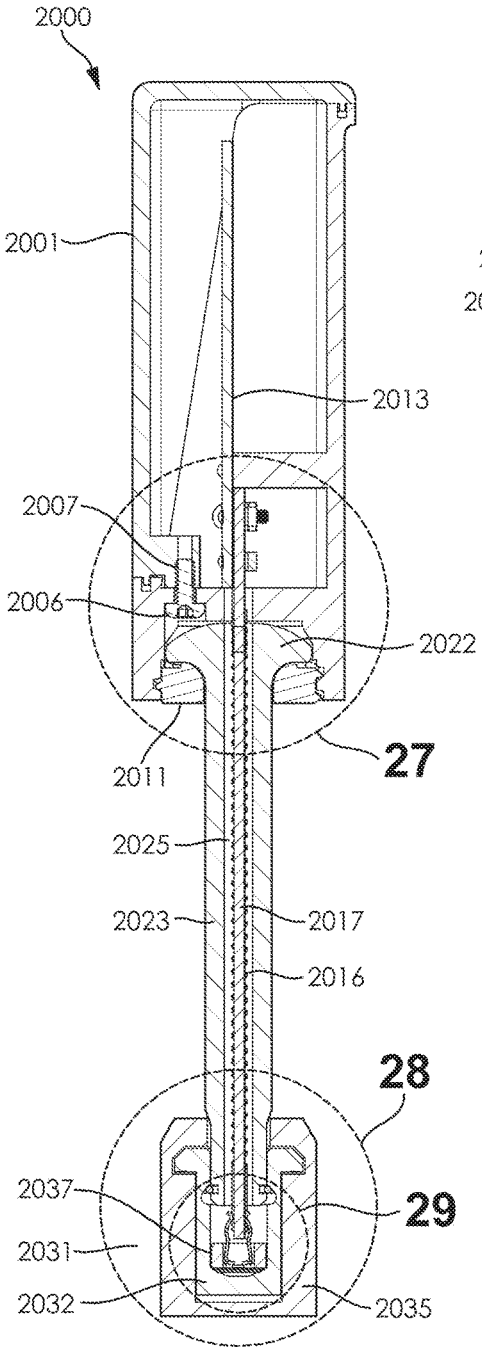
FIG. 26 is cross-section of a reusable version of a tamper-proof electronic bolt-seal in accordance with an embodiment of the present invention.
Figure 27:
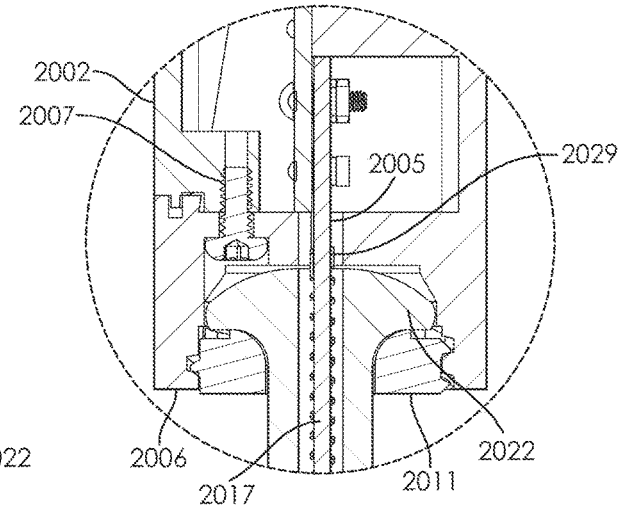
FIG. 27 is a detailed cross-section of the connection between the bolt shank and enclosure of a reusable version of a tamper-proof electronic bolt-seal in accordance with an embodiment of the present invention.
Figure 28:
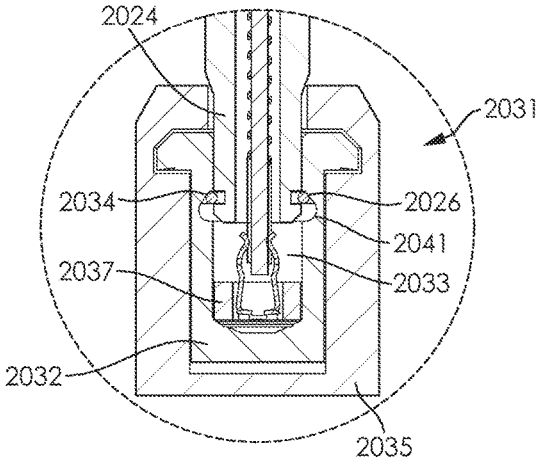
FIG. 28 is a detailed cross-section of the connection between the bolt shank and bolt lock assembly of a reusable version of a tamper-proof electronic bolt-seal in accordance with an embodiment of the present invention.
Figure 29:
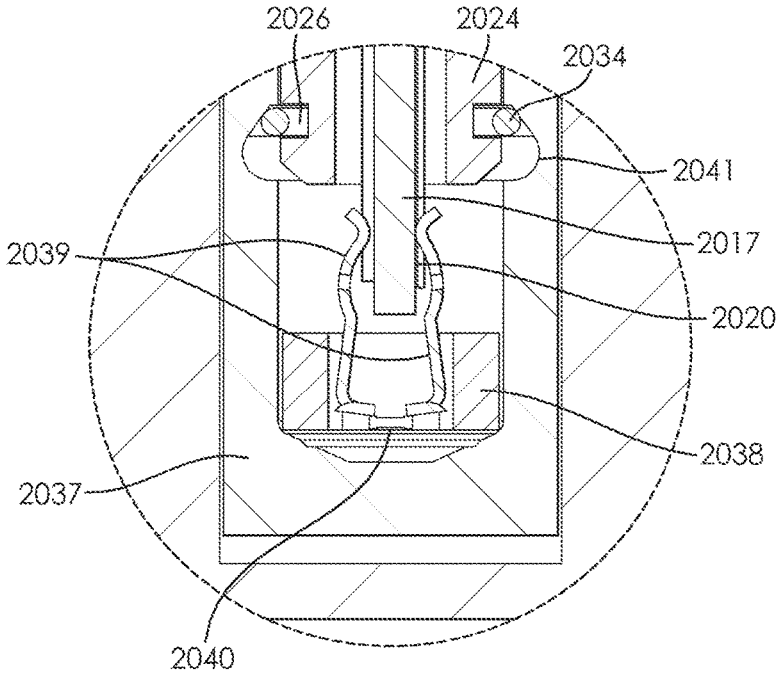
FIG. 29 is a detailed cross-section of electrical contact between the resistive sensor wire armature and contact disc assembly of a reusable version of a tamper-proof electronic bolt-seal in accordance with an embodiment of the present invention.

Turning now to FIG. 26, a cross-section of the reusable version of the tamper-proof electronic bolt-seal, which is shown in greater detail in FIGS. 27-29. As shown by FIG. 26, the circuit board 2013 of the tamper detection sensor is housed in the enclosure 2001 and the resistive wire 2016 and armature 2017 of the tamper detection sensor are primarily retained in the hole 2025 formed though the center of the bolt shank shaft 2023. As shown by FIG. 27, a collar 2006 at the bottom of the enclosure 2001 engages with the bolt shank head 2022. In particular, a jam nut 2011 screws into the collar 2006 to secure the bolt shank head 2022 to the enclosure 2001. The enclosure cover 2002 is secured by an enclosure cover screw 2007 that is concealed by the jam nut 2011 and the bolt shank head 2022. FIG. 27 also shows how the armature 2017 passes through the bottom of the enclosure 2001 via the armature pass-through 2005. As shown by FIG. 28, the bolt lock assembly 2031, attaches to the bolt shank tip 2024. Specifically, as the bolt shank tip 2024 passes through the bolt lock over-mold 2035 and into the bore 2033 of the bolt lock 2032, the retaining ring notch 2026 on the bolt shank tip 2024 passes the retaining ring groove 2041 where the retaining ring 2034 engages with the retaining ring notch 2026. A contact disc assembly 2037 is located at the bottom of the bolt lock bore 2033. As shown by FIG. 29, as retaining ring notch 2026 of the bolt shank tip 2024 is engaged by the retaining ring 2034, the bolt lock contact 2020 on the armature 2017 becomes electrically coupled with the vertical contact members 2039 of the contact disc assembly 2037. The contact disc assembly 2037 primarily comprises two vertical contact members 2039 that extend vertically from a contact disc 2038 and are connected by a resistor bridge or wire 2040.

It should be noted that the features illustrated in the drawings are not necessarily drawn to scale, and features of one embodiment may be employed with other embodiments as the skilled artisan would recognize, even if not explicitly stated herein. Descriptions of well-known components may be omitted so as to not unnecessarily obscure the embodiments. One of ordinary skill in the art could employ other mechanical parts for physically securing a closed container including but not limited to different configurations of pins, bolts, and fasteners in conjunction with the disclosed electronics and unique identification scheme presented in here. As an illustrative example, the mechanical seal could be provided by a cable seal instead of a bolt seal, with the cable seal incorporating the electronics and identification system described herein.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An electronic security device, comprising:

a mechanical fastener configured to physically secure a container latch in a closed position;

at least one non-zero electrical resistor embedded in said mechanical fastener, wherein said non-zero electrical resistor has a resistance value that changes when said mechanical fastener is tampered with; and electronics, circuitry, and a digital memory that contains a unique electronic identification code for said electronic security device, wherein said electronic identification code is combined with said resistance value of said non-zero electrical resistor to create a unique seal identification code when said electronic security device is fastened to said container latch;

wherein the resistance value is randomized based on a randomized embedded length of the non-zero electrical resistor, the randomized embedded length being embedded in said mechanical fastener.

2. The electronic security device of claim 1, wherein said non-zero electrical resistor is a wire winding.

3. The electronic security device of claim 2, further comprising an armature around which said wire winding is wrapped.

4. The electronic security device of claim 1, wherein said non-zero electrical resistor is formed by a contact disk.

5. The electronic security device of claim 1, wherein said non-zero electrical resistor is formed by a miniature discrete resistor.

6. The electronic security device of claim 1, wherein said electronics include at least one of a wireless link and a battery.

7. The electronic security device of claim 6, wherein said wireless link is a passive radio frequency identification (RFID) protocol and at least a portion of said electronics is powered up when said electronic security device is in proximity to a reader.

8. The electronic security device of claim 1, wherein a change in said resistance value of said non-zero electrical resistor is detected as a breach event and recorded in said digital memory.

9. The electronic security device of claim 8, wherein a time and a location of said breach event is recorded in said digital memory.

10. The electronic security device of claim 1, wherein said electronics include a global positioning system (GPS) module.

11. The electronic security device of claim 1, wherein a plurality of non-zero electrical resistors are employed and said resistance value is a combined resistance value of all of said non-zero electrical resistors.

12. The electronic security device of claim 1, wherein tampering with said electronic security device will cause a resistance value change in at least one of said non-zero electrical resistors.

13. The electronic security device of claim 1, wherein said mechanical fastener is a bolt seal including:

a bolt shank including a bolt head, a bolt shaft, and a bolt tip; and a bolt lock assembly including a bolt lock formed with a bore that is configured to engage with said bolt tip.

14. The electronic security device of claim 13, wherein said bolt shank further includes an alignment key adapted to align said bolt shank with said bolt lock assembly and an alignment key slot adapted to retain said alignment key.

15. The electronic security device of claim 13, further comprising an enclosure formed with a collar configured to engage with said bolt head, wherein said enclosure is configured to retain said electronics, said circuitry, and said digital memory.

16. The electronic security device of claim 15, wherein said enclosure further includes a jam nut that is configured to engage with said collar to attach said enclosure to said bolt head to said enclosure.

17. A method for detecting a breach attempt on an electronic security device, said method comprising the steps of:

attaching said electronic security device to a container latch to establish a continuity circuit for said electronic security device, wherein said continuity circuit has a baseline resistance value that is a unique baseline resistance value based on a randomized embedded length of an electrical resistor that is embedded in a mechanical fastener of said electronic security device;

generating a unique seal identification based in part on said baseline resistance value of said continuity circuit and an electronic identification code associated with said electronic security device;

recording said unique seal identification to a data store as an original seal identification;

scanning said electronic security device to obtain a current seal identification of said electronic device;

comparing said current seal identification to said original seal identification; and issuing an identification mismatch alert for any mismatch between said current seal identification and said original seal identification.

18. The method of claim 17, further comprising:

recording any resistance change in said baseline resistance value that is outside of a tolerance threshold as a breach event, wherein said electronic security device self-monitors for said resistance change;

scanning said electronic security device to retrieve any said breach event that has been recorded; and issuing a breach event alert for any said breach event.

19. An electronic security device, said device comprising:

a mechanical fastener configured to physically secure a container latch in a closed position, the mechanical fastener including a shank and a lock assembly;

at least one non-zero electrical resistor disposed in a hole of the shank, wherein said non-zero electrical resistor has a resistance value that changes when said mechanical fastener is tampered with; and electronics, circuitry, and a digital memory that contains a unique electronic identification code for said electronic security device, wherein said electronic identification code is combined with said resistance value of said non-zero electrical resistor to create a unique seal identification code when said electronic security device is fastened to said container latch;

wherein the lock assembly is disposed at a first end portion of the shank and the digital memory is disposed at a second end portion of the shank that is distal from the first end portion; and wherein the resistance value is randomized based on a randomized embedded length of the non-zero electrical resistor, the randomized embedded length being embedded in said mechanical fastener.

20. The electronic security device of claim 19, wherein the shank is a substantially straight shank.

* * * * *